US009084711B2

(12) United States Patent
Kawakami et al.

(10) Patent No.: US 9,084,711 B2
(45) Date of Patent: Jul. 21, 2015

(54) HUMAN HEALING ABILITY ENHANCING APPARATUS AND METHOD FOR ACTUATING HUMAN HEALING ABILITY ENHANCING APPARATUS

(75) Inventors: Yukichika Kawakami, Iwaki (JP); Masayuki Niwa, Tokyo (JP)

(73) Assignees: Yukichika Kawakami, Iwaki, Fukushima (JP); Yosuke Kawakami, Iwaki, Fukushima (JP)

( * ) Notice: Subject to any disclaimer, the term of this patent is extended or adjusted under 35 U.S.C. 154(b) by 450 days.

(21) Appl. No.: 13/505,919

(22) PCT Filed: Nov. 22, 2010

(86) PCT No.: PCT/JP2010/070771
§ 371 (c)(1),
(2), (4) Date: Jun. 28, 2012

(87) PCT Pub. No.: WO2011/065319
PCT Pub. Date: Jun. 3, 2011

(65) Prior Publication Data

US 2012/0266874 A1 Oct. 25, 2012

(30) Foreign Application Priority Data

Nov. 24, 2009 (JP) ..... 2009-266237
Apr. 30, 2010 (JP) ..... 2010-105054

(51) Int. Cl.

| | |
|---|---|
| ***A61M 11/00*** | (2006.01) |
| ***A61G 10/02*** | (2006.01) |
| ***A61H 33/14*** | (2006.01) |
| *A61H 33/06* | (2006.01) |

(52) U.S. Cl.
CPC ..... *A61G 10/023* (2013.01); *A61H 33/14* (2013.01); *A61H 33/066* (2013.01); *A61H 2033/143* (2013.01); *A61H 2201/50* (2013.01)

(58) Field of Classification Search
CPC ..... A61G 10/023; A61G 2203/46
USPC ..... 128/205.11, 200.24, 202.12, 205.26
See application file for complete search history.

(56) References Cited

U.S. PATENT DOCUMENTS

| | | | | |
|---|---|---|---|---|
| 5,503,143 | A * | 4/1996 | Marion et al. | 128/202.12 |
| RE36,958 | E * | 11/2000 | Gamow | 128/202.12 |
| 7,503,322 | B2 * | 3/2009 | Harris | 128/202.12 |
| 7,556,040 | B2 * | 7/2009 | Meyer et al. | 128/205.26 |
| 7,926,483 | B2 * | 4/2011 | Lundeen | 128/202.12 |

(Continued)

FOREIGN PATENT DOCUMENTS

| | | | |
|---|---|---|---|
| CN | 1300585 | A | 6/2001 |
| CN | 101380263 | A | 3/2009 |

(Continued)

OTHER PUBLICATIONS

China Patent Office, "office action for CN 201080053100.0", Jun. 21, 2013.

*Primary Examiner* — Steven Douglas
(74) *Attorney, Agent, or Firm* — Manabu Kanesaka

(57) ABSTRACT

A human healing ability enhancing apparatus includes an airtight part that is capable of being airtight; a decompression pump that decompresses air pressure in the airtight part and communicates with an exhaust port of the airtight part; and an over-decompression prevention device for preventing over-decompression in which the air pressure in the airtight part is lower than a predetermined threshold air pressure.

8 Claims, 16 Drawing Sheets

(56) References Cited

U.S. PATENT DOCUMENTS

| | | | | |
|---|---|---|---|---|
| 8,251,057 | B2 * | 8/2012 | Butler | 128/202.12 |
| 2004/0154616 | A1 * | 8/2004 | Parker Risley et al. | 128/202.12 |
| 2006/0264696 | A1 | 11/2006 | Lundeen | |
| 2008/0178877 | A1 * | 7/2008 | Gurnee et al. | 128/202.12 |
| 2008/0210234 | A1 * | 9/2008 | O'Brien et al. | 128/202.12 |
| 2010/0037892 | A1 * | 2/2010 | Bartlett | 128/202.12 |

FOREIGN PATENT DOCUMENTS

| | | | |
|---|---|---|---|
| JP | 2613491 | B | 5/1997 |
| JP | 2004-202156 | A | 7/2004 |
| JP | 2005-312792 | A | 11/2005 |
| JP | 4175460 | B2 | 11/2008 |

* cited by examiner

Fig. 7a
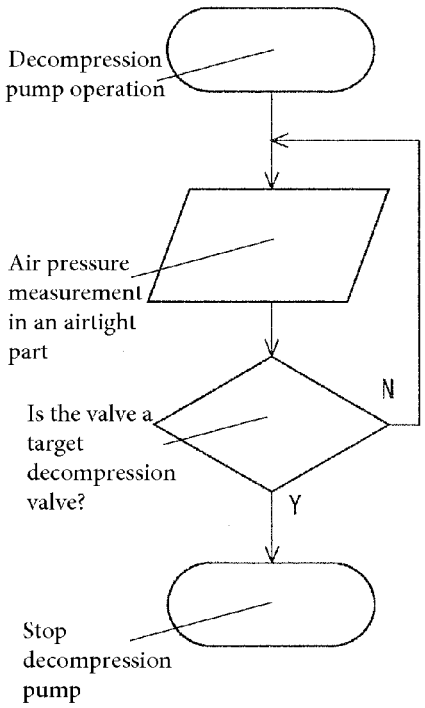
Fig. 7b
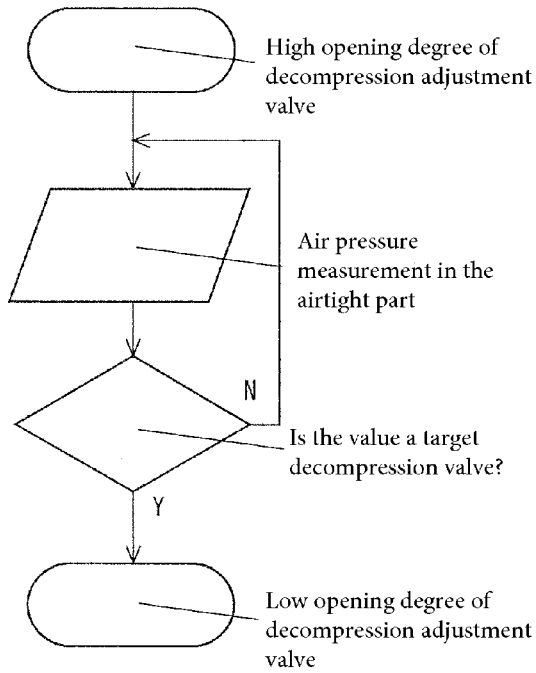
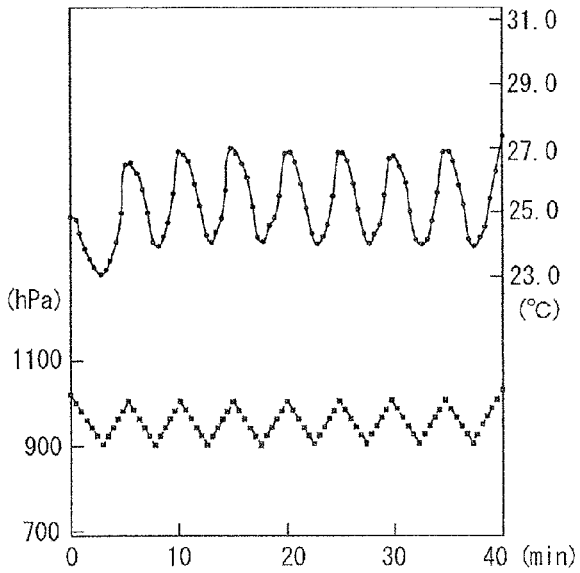
Fig. 8

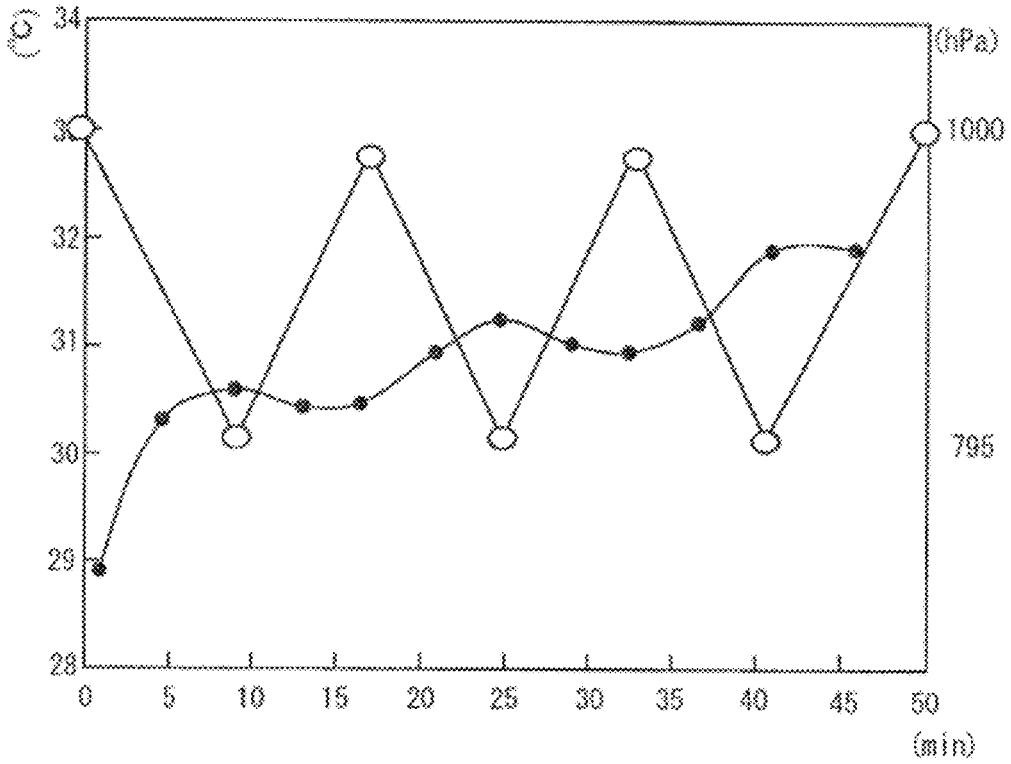
Fig. 21
Fig. 22a
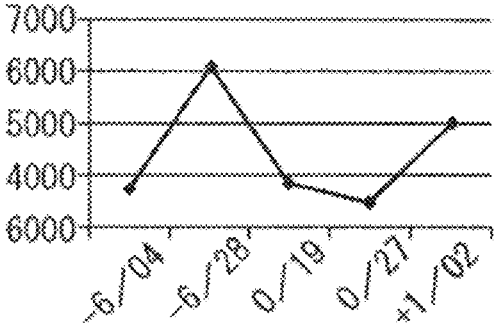
Fig. 22b
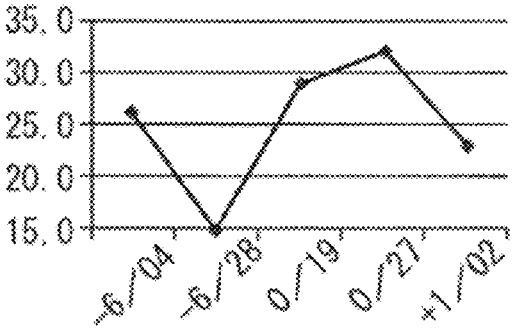
Fig. 22c
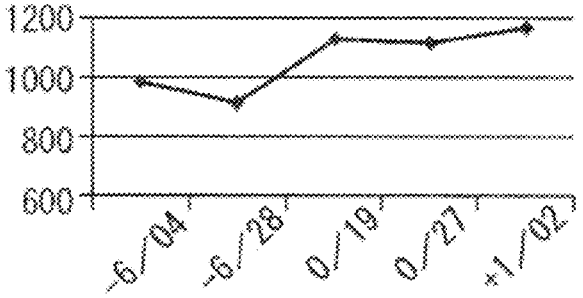

HUMAN HEALING ABILITY ENHANCING APPARATUS AND METHOD FOR ACTUATING HUMAN HEALING ABILITY ENHANCING APPARATUS

RELATED APPLICATIONS

The present application is National Phase of International Application No. PCT/JP2010/070771 filed Nov. 22, 2010, and claims priority from Japanese Applications No. 2009-266237, filed Nov. 24, 2009 and No. 2010-105054, filed Apr. 30, 2010.

TECHNICAL FIELD

The present invention relates to a human healing ability enhancing apparatus that uses decompression of air and restoration to a normal pressure state, and further relates to a method for actuating the human healing ability enhancing apparatus.

BACKGROUND ART

An air bath is one of the methods to train a body and to prevent illness by exposing the body in a specific air environment and by using physical properties and chemical components of air. The air bath equally provides favorable influence on both conditioning of blood circulation and human tissues and organs. It is said that trace elements in air, inorganic salts, oxygen and the like can enhance activity and an immune function of an organic body, and increase in oxygen content in the blood by absorbing fresh air is highly effective for assisting protection of a cardiopulmonary function.

For training a body by employing the air bath, a stimulus caused by difference between temperature of air (air temperature) and a body temperature is mainly used. Thermal change of air temperature activates a thermoregulation function of body, cerebral cortex, and reflex center of vasomotion, and favorably trains the body. For example, a stimulus caused by cold air constricts blood vessels in the body surface and allows blood to flow in a direction of internal organs. On the contrary, a stimulus caused by warm air dilates blood vessels in the body surface and allows blood to flow in a direction of the body surface. In addition, the air bath is expected to provide stress relaxation for not only humans but also animals.

One of the inventors of the present invention has offered an optimal pressure control apparatus and a method for controlling pressure of the apparatus in order to take the air bath using a stimulus caused by temperature difference (Patent Document 1).

CITATION LIST

Patent Literature

Patent Literature 1: Japanese Patent Application Publication No. 2010-167118

SUMMARY OF THE INVENTION

Problem to be Solved by the Invention

The present invention is accomplished because more natural healing capacity effect in which abnormal body tissues and body organs are recovered to healthy body tissues and body organs has been confirmed. This effect is caused by a stimulus that is sequentially repeated between a decompression state that is equal to or higher than a threshold air pressure and a wide-range normal pressure state that is a normal pressure or a pressure higher than the decompression state and lower than the normal pressure generated by this pressure control apparatus.

In other words, the present invention aims to obtain a human healing ability enhancing apparatus that can favorably provide a stimulus for enhancing natural healing capacity of a living body. The present invention also aims to obtain a method for favorably actuating the apparatus that provides the stimulus.

Means for Solving the Problem

A human healing ability enhancing apparatus according to the present invention described in claim 1 includes an airtight part that is capable of being airtight;

a decompression pump that decompresses an air pressure in the airtight part and communicates with an exhaust port of the airtight part; and an over-decompression prevention device for preventing over-decompression in which the air pressure in the airtight part is lower than a predetermined threshold air pressure; in which the apparatus further includes a decompression control means; and in which the decompression control means sequentially and repeatedly controls a decompressing process in which the air pressure in the airtight part is changed to a decompression state that is equal to or higher than the threshold air pressure during 1 to 60 minute(s) and a pressurizing process in which the decompression state is changed to a wide-range normal pressure state that is a normal pressure or a pressure higher than the decompression state and lower than the normal pressure during 1 to 60 minute(s).

The human healing ability enhancing apparatus according to the present invention described in claim 2 is the apparatus according to claim 1, in which the decompression control means provides higher pressure change per unit time in the pressurizing process than that in the decompressing process.

The human healing ability enhancing apparatus according to the present invention described in claim 3 is the apparatus according to claim 1 or 2, in which the airtight part encapsulates a whole human body in the airtight part.

The human healing ability enhancing apparatus according to the present invention described in claim 4 is the apparatus according to claim 3, further including an oxygen deficiency prevention means for preventing oxygen deficiency in the airtight part.

A method for actuating human healing ability enhancing apparatus according to the present invention described in claim 5 is a method for actuating a human healing ability enhancing apparatus including: an airtight part that is capable of being airtight; a decompression pump that decompresses an air pressure in the airtight part and communicates with an exhaust port of the airtight part; and an over-decompression prevention device for preventing over-decompression in which the air pressure in the airtight part is lower than a predetermined threshold air pressure; the method including: decompressing an air pressure in the airtight part to a decompression state that is equal to or higher than the threshold air pressure during 1 to 60 minute(s) to reduce an air temperature in the airtight part by adiabatic expansion effect; and pressurizing the air pressure in the decompression state to a wide-range normal pressure state that is a normal pressure or a pressure higher than the decompression state and lower than the normal pressure during 1 to 60 minute(s) to restore the air temperature in the airtight part to an air temperature that is equal to or higher than the initial air temperature of the airtight part; in which decompressing process and pressurizing process are sequentially repeated.

The method for actuating the human healing ability enhancing apparatus according to the present invention described in claim 6 is the method according to claim 5, in which the pressurizing process has higher pressure change per unit time than the decompressing process when the decompressing process and the pressurizing process are sequentially repeated.

The method for actuating human healing ability enhancing apparatus according to the present invention described in claim 7 is the method according to claim 5 or 6, in which the airtight part encapsulates a whole human body in the airtight part.

The method for actuating human healing ability enhancing apparatus according to the present invention described in claim 8 is the method according to any one of claims 1 to 7, in which the human healing ability enhancing apparatus further includes an air supply pipe that sequentially sucks outside air naturally depending on the air pressure in the airtight part.

Advantageous Effects of the Invention

The present invention has an effect that can obtain a human healing ability enhancing apparatus that can favorably provide a stimulus for enhancing natural healing capacity of a living body and a method for actuating the human healing ability enhancing apparatus.

BRIEF DESCRIPTION OF DRAWINGS

FIG. 7*a* is a flow chart illustrating the decompressing process, and FIG. 7*b* is a flow chart illustrating the pressurizing process; and FIG. 8 is a graph illustrating measurement results of air temperature change in the airtight part when the decompressing process and the pressurizing process are repeated, and the vertical axis represents air pressure (hPa) and air temperature (° C.), and the horizontal axis represents time (min);

FIG. 21 is a graph illustrating comparison results of human healing ability enhancing effect;

FIG. 22 are graphs illustrating verification results 11 of human healing ability enhancing effect;

BEST MODES FOR CARRYING OUT THE INVENTION

In human healing ability enhancing apparatus according to the present invention, the human healing ability enhancing apparatus including: an airtight part that is capable of being airtight; a decompression pump that decompresses an air pressure in the airtight part and communicates with an exhaust port of the airtight part; and an over-decompression prevention device for preventing over-decompression in which the air pressure in the airtight part is lower than a predetermined threshold air pressure; in which the apparatus further includes a decompression control means; and in which the decompression control means sequentially and repeatedly controls a decompressing process in which the air pressure in the airtight part is changed to a decompression state that is equal to or higher than the threshold air pressure during 1 to 60 minute(s) and a pressurizing process in which the decompression state is changed to a wide-range normal pressure state that is a normal pressure or a pressure higher than the decompression state and lower than the normal pressure during 1 to 60 minute(s).

Figure 1:
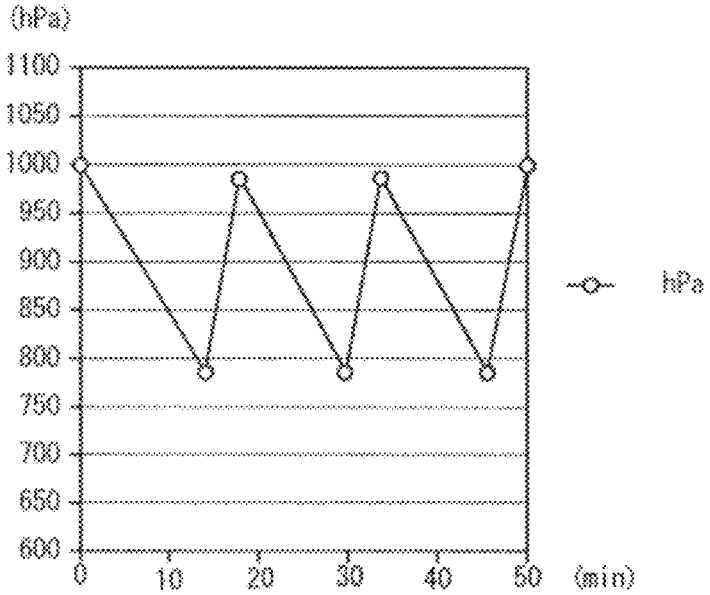
FIG. 1 is an explanatory graph illustrating air pressure change in an airtight part in the present invention by an example of repeating control of a decompressing process and a pressurizing process, and the vertical axis and the horizontal axis represent air pressure (hPa) and time (min), respectively.

More preferably, the pressurizing process has higher pressure change per unit time than the decompressing process. Here, "pressure change per unit time" is, for example, determined as a slope of the graph in which the vertical axis represents pressure and the horizontal axis represents time, as illustrated in FIG. 1. More specifically, for example, when a decompressing process decompresses a pressure from 1000 hPa to 795 hPa for 14 minutes, pressure change in unit time of the process is 205/14≅14.6 (hPa/min), while when the pressurizing process pressurizes the pressure from 795 hPa to 990 hPa for 4 minutes, pressure change in unit time of the process is 195/4≅48.8 (hPa/min). In this case, the pressurizing process has higher pressure change per unit time than the decompressing process, and the graph has the steeper slope. Thereby, a stimulus for enhancing natural healing capacity of a living body can favorably be provided.

The "human healing ability" mentioned in the present invention means ability for recovering from abnormal conditions to healthy conditions by a recovery function that a living body itself originally has. Specifically, the human healing ability comprehensively includes following (1) to (3).

(1) Natural healing capacity: Capacity in which people being as humans are not taken ill, obtained in a process of biological evolution.

(2) Natural healing ability: Ability in which humans have tried to adapt when natural environments (such as hotness and coldness) and social environments (such as stress) are changed.

(3) Self-healing ability: Ability in which a person having illness tries to heal by himself or herself.

In other words, the human healing ability recovers abnormal environments such as unusual compositions of body fluid such as blood, abnormal blood pressure, recovery of body tissue damage, and elimination of foreign matters (non-self matters) such as pathogenic microbes and viruses to stable states and heals these abnormal environments. More specifically, the human healing ability means activity trying to heal disorder of body functions and illness such as non-healthy and abnormal conditions to normal conditions. Therefore, "enhancing human healing capacity" means to enhance the natural healing capacity itself. This enhancing also includes further enhancement of reaction speed to rapidly recognize an abnormal conditions and response speed to try to recover to normal conditions.

For example, this enhancing includes shrinkage or extinction of tumor cells, which are not healthy cells; improvement of immune system hypersensitivity such as rheumatism; improvement of osteoporosis, which has unhealthy bone tissue; and improvement of abnormal sugar metabolism, which are described in the following examples. Although there are no specific data in the following examples, this enhancing may also include improvement of abnormal blood pressure, dissolution of thrombus, prevention of angina pectoris, cerebral thrombosis and brain hemorrhaging caused by thrombus, and improvement of dementia by improvement of cerebral blood stream.

Change in an air pressure cycles of the present invention improves natural healing capacity (living body's homeostatic mechanism) of an examinee by stimulating the examinee in the airtight part. More specifically, the change in the air pressure cycles probably improves response to activity trying to recover disorder of body functions and illness such as non-healthy abnormal conditions to normal conditions.

The threshold air pressure of the present invention varies between individuals, and a threshold value of the air pressure varies depending on conditions of healthy persons or persons suffering from illness. The threshold value can be decreased by experiences, and, on the contrary, the threshold value may be increased by physical conditions. Generally, in a pressurized cabin in an airplane, at an altitude of 12000 m, the air pressure state is set to around an altitude of 2000 m (about 780 hPa). Consequently, even a person suffering from illness can use the pressurized cabin. Therefore, the threshold value of a general healthy examinee is at least higher than an altitude of 2000 m, and equal to or lower than an altitude of about 3000 m, that is, 700 hPa or more.

For the decompression control means of the decompression pump in the present invention, any means for sequentially and repeatedly controlling air pressure cycles varied between a decompression state and a wide-range normal pressure state may be used. The decompression state means a decompression state that is equal to or higher than the threshold air pressure. The air pressure in this decompression state also varies its value depending on conditions of healthy persons or persons suffering from illness. For example, the decompression state is set to an air pressure at an altitude of 1000 m, and the wide-range normal pressure state is set to an air pressure at an altitude of 50 m. This air pressure change between the decompression state and the wide-range normal pressure state is repeated.

A preferable decompression state is 700 hPa, which is corresponding to an altitude of 3000 m, or more and 950 hPa or less, and more preferably 800 hPa or more and 900 hPa or less. A preferable wide-range normal pressure state is equal to or lower than the normal pressure (1013 hPa) or 1000 hPa, which is corresponding to an altitude of 100 m, or more.

The sequential and repeated decompression states may be decompression that is equal to or lower than the threshold air pressure, and may not be the same air pressure. For example, different decompression states such as a first decompression state of 780 hPa, which is corresponding to an altitude of 2000 m, and a second decompression state of 700 hPa, which is corresponding to an altitude of 3000 m, can be used. Similarly, the repeated wide-range normal pressure states may be the normal pressure or an air pressure higher than the immediately preceding decompression state and lower than the normal pressure, and may not be the same air pressure. For example, different air pressure states such as a first wide-range normal pressure state of the normal pressure (1013 hPa), and a second wide-range normal pressure state of 989 hPa, which is corresponding to an altitude of 200 m, can be used.

When an installation location of the human healing ability enhancing apparatus of the present invention is a high altitude environment such as Mexico City, a pressurizing device for pressurizing to the normal pressure (1013 hPa) or an altitude of 200 m (989 hPa) is preferably provided. However, this pressurizing device preferably does not pressurize over the normal pressure.

Change speed from the decompression state to the wide-range normal pressure state or from the wide-range normal pressure state to the decompression state in the airtight part may be a speed that provides a stimulus enhancing natural healing capacity effect for an examinee. The speed that needs to equalize the examinee's ear pressure may provide the stimulus for enhancing the natural healing capacity effect for the examinee. Examples of the change speed include a change speed from the decompression state to the wide-range normal pressure state during 1 to 60 minute(s) or a change speed from the wide-range normal pressure state to the decompression state during 1 to 60 minute(s). Specifically, the examples of the change speed include a change speed from the normal pressure (about 1013 hPa) to an air pressure corresponding to an altitude of 1000 m (about 900 hPa) during 3 minutes, and a subsequent change speed from the air pressure to an air pressure corresponding to an altitude of 200 m (about 989 hPa) during 1.5 minutes, and these changes are sequentially repeated.

In examples described below, it is proved that the stimulus caused by sequential air pressure change between the decompression state and the wide-range normal pressure state enhances the natural healing capacity effect for the examinees. This operation mechanism is probably based on the assumptions 1 and 2 described above.

For a size of the airtight part and a capacity of the decompression pump, an airtight part and a decompression pump that have volumes where rapid decompression change that causes adiabatic expansion can be generated, and pressure change from the decompression state to the wide-range normal pressure state can be performed rapidly may be used. An airtight part that has large capacity includes one or more decompression pumps having large capacity and one or more air supply means having large capacity for supplying air to the airtight part. On the other hand, when an airtight part having small capacity is formed, the apparatus does not need to be large. Examples of the large airtight part including a chamber having a capacity where several persons can take the air bath at a time can be realized. Examples of the small airtight part include the airtight part having such a capacity that one person can lie down. The airtight part having such a capacity that pets such as dogs and cats can be encapsulated may be formed. In this case, the "human healing ability enhancing apparatus" turns into a "living body healing ability enhancing apparatus", because pets are not humans.

In any cases, in order to provide the stimulus of sequential air pressure change between the decompression state and the wide-range normal pressure state for the examinee, the airtight part in which at least whole examinee's body is encapsulated in the airtight part is preferable. Therefore, the airtight part of the present invention encapsulates the whole human body in the airtight part. Specifically, the airtight part encapsulates the whole human body in the airtight part; the airtight part is constituted as a chamber where the whole human body can be entered; the examinee enters into the airtight chamber; and then air pressure change between the decompression state and the wide-range normal pressure state is repeated. In this case, the apparatus further includes an oxygen deficiency prevention means for preventing oxygen deficiency in the airtight part.

Examples of the oxygen deficiency prevention means of the present invention include installation of a suction pipe that introduces outside air equal to or less than an air displacement volume of the decompression pump into the airtight part so as to naturally suck outside air depending on the air pressure in the airtight part, and a door or an air vent that automatically opens at a time of electric power failure or other failures to prevent oxygen deficiency in the airtight part. By this oxygen deficiency prevention means, outside air is naturally sucked into the decompressed airtight part.

The human healing ability enhancing apparatus of the present invention may further include one or more various other means for enhancing natural healing capacity of the living body in the airtight part other than the decompression control means and the oxygen deficiency prevention means. Examples of other means may further include an oxygen supply means for increasing oxygen partial pressure, which decreases in the decompression state, in the airtight part, a humidification means for adding humidity, which decreases in the decompression state, in the airtight part, a warming means for raising temperature, which decreases in the decompression state, in the airtight part, and a negative ion addition means for increasing negative ions in the airtight part.

In a method according to the present invention, human healing ability enhancing apparatus can be operated by a method for actuating a human healing ability enhancing apparatus including: an airtight part that is capable of being airtight; a decompression pump that decompresses an air pressure in the airtight part and communicates with an exhaust port of the airtight part; and an over-decompression prevention device for preventing over-decompression in which the air pressure in the airtight part is lower than a predetermined threshold air pressure; the method including: decompressing an air pressure in the airtight part to a decompression state that is equal to or higher than the threshold air pressure during 1 to 60 minute(s) to reduce an air temperature in the airtight part by adiabatic expansion effect; and pressurizing the air pressure in the decompression state to a wide-range normal pressure state that is a normal pressure or a pressure higher than the decompression state and lower than the normal pressure during 1 to 60 minute(s) to restore the air temperature in the airtight part to an air temperature that is equal to or higher than the initial air temperature of the airtight part; in which decompressing process and pressurizing process are sequentially repeated.

The human healing ability enhancing apparatus in the method according to the present invention may be an apparatus, which is similar to the above-described human healing ability enhancing apparatus, including an airtight part that is capable of being airtight; a decompression pump that decompresses air pressure in the airtight part and communicates with an exhaust port of the airtight part; and an over-decompression prevention device for preventing over-decompression in which the air pressure in the airtight part is lower than a predetermined threshold air pressure. Each of the airtight part, the decompression pump and the over-decompression prevention device are the same as described above.

In the present invention, the method may sequentially repeats decompressing an air pressure in the airtight part to a decompression state that is equal to or higher than the threshold air pressure during 1 to 60 minute(s) to reduce an air temperature in the airtight part by adiabatic expansion effect, and pressurizing the air pressure in the decompression state to a wide-range normal pressure state that is a normal pressure or a pressure higher than the decompression state and lower than the normal pressure during 1 to 60 minute(s) to restore the air temperature in the airtight part to an air temperature that is equal to or higher than the initial air temperature of the airtight part. Specifically, the method may include controlling the air pressure by providing the decompression control means that controls the decompression pump in the human healing ability enhancing apparatus described above, and also may include changing air pressure in the airtight part with an operator checking air gauges in the airtight part.

In the present invention, a detailed mechanism of action of the human healing ability enhancing effect caused by sequentially and repeatedly controlling between the decompression state that is equal to or more than the threshold air pressure and the wide-range normal pressure state that is the normal pressure or a pressure higher than the decompression state and lower than the normal pressure will be clarified by future verifications and accumulation of data. However, several hypotheses of the mechanism of action are considered.

Hypothesis 1. Protection Mechanism by Low Oxygen

When a person moves from lowland to highland (that is, moves toward a place containing lower oxygen concentration), the "protection mechanism" of living bodies probably acts as continuously obtaining more amount of oxygen than a theoretical value (the same amount of oxygen as a use amount of oxygen at flatland) during the movement from the lowland to the highland. From this, it is found that generation of "ATP" increases because increase in body temperature is observed even if transfer speed from the normal pressure state to the decompression state is changed.

On the contrary, when the person moves from the highland to the lowland (that is, moves from a place containing lower oxygen concentration to a place containing common oxygen concentration), the protection mechanism works slowly because the person moves toward the place containing higher oxygen concentration, that is, to a direction where cells easily produce ATP. Therefore, there are conditions in which the theoretical value and the transfer speed are almost equal. In order to intend to increase generation of ATP, a faster transfer speed than the transfer speed described above is required. In other words, as a result, the faster the transfer speed, the easier the generation of ATP.

Figure 2:
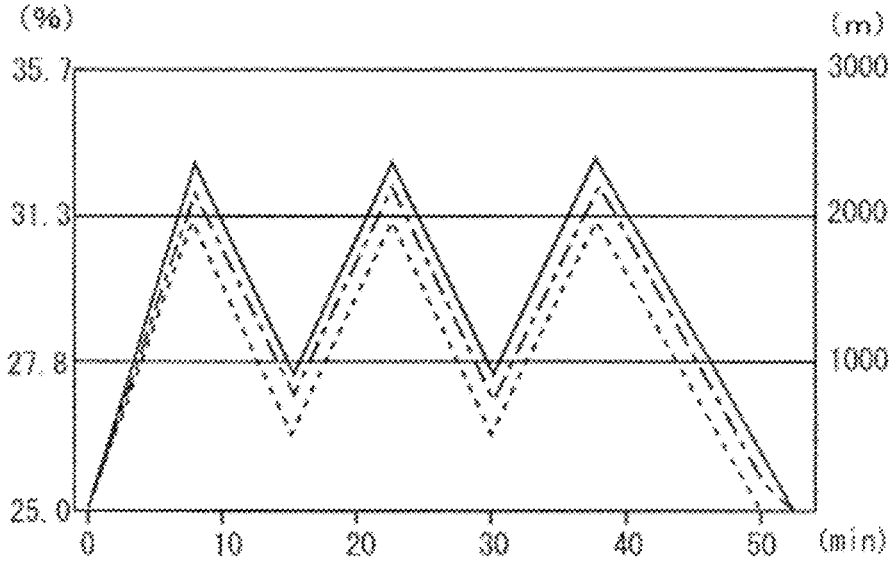
FIG. 2 is a graph illustrating change in an oxygen use ratio in expiratory air when the decompressing process and a pressurizing process are sequentially and repeatedly controlled; the vertical axis represents an oxygen use ratio (%) in expiratory air and altitude (m) and the horizontal axis represents operation time (min); and, in the graph, the dashed line, the solid line and the chain line represent a required amount of oxygen, an obtained amount of oxygen by protective mechanism, and an increased amount in ATP production, respectively.

FIG. 2 is a graph illustrating change in an oxygen use ratio in expiratory air when the decompressing process and a pressurizing process are sequentially and repeatedly controlled. In the hypothesis, the use ratio of oxygen in expiratory air by lung breathing during rest is noted. Considering from energy metabolism, an amount of oxygen carried by hemoglobin should be constant for "ATP" production.

More specifically, if oxygen corresponding to 25.0% in expiratory air is used in flatland, for example, 27.8% of oxygen in expiratory air is probably used because oxygen concentration is decreased in 10% at an altitude of 1000 m. Similarly, 31.3% of oxygen is used at an altitude of 2000 m. All of them are determined by the work of "protection mechanism" of living bodies. Because a person has a margin of an amount of oxygen in expiratory air up to an altitude of about 3000 m, the oxygen concentration can be changed. However, when the oxygen concentration becomes thinner than that altitude, individual difference in oxygen adsorption amounts to hemoglobin occurs and low-oxygen injury may occur.

Therefore, a hypothesis of the "protection mechanism" caused by low oxygen in which the protection mechanism works rapidly and safely when a person goes toward a dangerous side (low oxygen) and works slowly when the person goes toward a safety side (high oxygen) is verified. In other words, as illustrated in FIG. 2, the oxygen carrying ability of hemoglobin is probably shifted to the safety side during the change in altitude and an amount of oxygen higher than the theoretical value is continuously carried. Excess oxygen obtained by this mechanism is sent to mitochondria. As a result, production of ATP increase and rise in body temperature are observed. The natural healing capacity enhancing effect is probably obtained by ATP of which production is increased.

Hypothesis 2. Signaling by Secretion of Nitrogen Monoxide and Other Substances

In vascular endothelial cells, gaseous nitrogen monoxide (hereinafter described as "NO") is secreted by a stimulus such as sheer stress caused by blood stream. This NO is referred to as an endothelium-derived relaxing factor (EDRF) of blood vessel. Dr. R. F. Furchgott, Dr. L. J. Ignarro and Dr. F. Murad have received the Nobel Prize in Medicine in 1998 by identifying that NO itself is the endothelium-derived relaxing factor and discovering NO as the signaling substance.

It has been found that NO as the signaling substance is generated in the living body for preventing cardiac episode by preventing plaques that cause occlusion in arteries and veins from attaching to blood vessels as well as maintaining normal blood pressure by flaccidity of arteries to adjust blood stream. NO is thought as a wonderful chemical substance for maintaining health of the cardiovascular system generated in the loving body. The hypothesis 2 is that the signaling by this NO is a main action mechanism itself of the natural healing capacity enhancing effect of the present invention.

In other words, in the present invention, by repeating between the decompression state that is equal to or higher than the threshold air pressure and the wide-range normal pressure state that is the normal pressure or a pressure higher than the decompression state and lower than the normal state for 4 to 5 times within 40 to 60 minutes, the blood vessel itself repeats dilation and restoration.

Figure 3A:
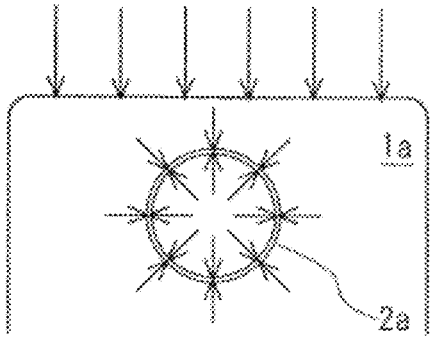
FIG. 3 are explanatory diagrams illustrating a blood vessel state at a normal pressure and a decompressed pressure.

More specifically, blood is transferred at almost constant blood pressure in a living body. At this time, when a pressure of outside air surrounding the living body is decompressed, the blood vessel dilates due to decrease in an outside pressure compared to an inner pressure. FIG. 3 are explanatory diagrams illustrating a blood vessel state under a normal pressure and a decompressed pressure. As illustrated in FIG. 3*a*, under the normal pressure, a blood vessel 2*a* located near the surface of a body 1*a* is pushed from outside of the blood vessel 2*a* at a pressure that can be balanced against a pressure of the blood in the blood vessel 2*a*.

Figure 3B:
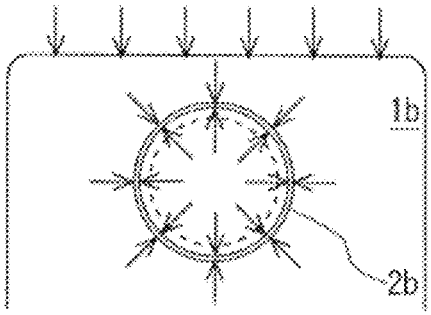

On the other hand, as illustrated in FIG. 3*b*, in the decompression state, the pressure itself pushing the surface of the body 1*b* is decreased. As a result, in the blood vessel 2*b* located near the surface of the body 1*b*, the blood vessel 2*b* itself dilates by the pressure of blood in the blood vessel 2*b* so as to balance a resultant force made of a counter force of blood vessel wall itself of the blood vessel 2*b* and a pressure from the outside of the blood vessel 2*b* with the pressure of blood in the blood vessel 2*b*.

When the pressure of the outside air is restored, the blood vessel restores from the dilation state to the usual state. A substance enhancing natural healing capacity is secreted by repeating dilation and restoration, as if the blood vessel is massaged.

As described above, it has been known that NO is also secreted by a stimulus generated by sheer stress caused by blood stream, and relaxes smooth muscle cells of the blood vessel. Particularly, as described in the present invention, the relaxation state and the restoration state of the blood vessel are sequentially and physically repeated by exposing the body to the atmosphere sequentially repeating the decompression state and the wide-range normal pressure state. It is no wonder that secretion of NO is easily promoted by this mechanism. This supports the natural healing capacity enhancing effect of the present invention.

As described above, since NO is referred to as the endothelium-derived relaxing factor (EDRF), following various effects caused by NO, including (1) Effect for reducing blood pressure, are generated by relaxing the smooth muscle cells of the blood vessel to supple and to dilate the muscle itself of the blood vessel and to improve blood stream. Followings are other effects confirmed at the present day.

(2) NO is an antioxidative substance, and therefore, NO removes free radicals such as active oxygen, suppresses platelet aggregation, prevents oxidation of cholesterol and generation of thrombus, and prevents arteriosclerosis, cardiac disease and cerebral stroke. In addition, improvement effects of excessive sensitivity to cold, stiffness in shoulders, and chronic fatigue are observed by improving blood stream and blood pressure by NO and relaxing.

(3) Prostaglandin $I_2$ ($PGI_2$) synthase is activated and production of $PGI_2$ is increased. $PGI_2$ directly works on vascular endothelial cells to increase cAMP concentration in the cells and to increase NO production. NO synergistically increases prostaglandin $I_2$ ($PGI_2$) production (positive feedback).

(4) The blood vessel massage by air pressure change secretes signaling substances other than NO.

For example, (4-1) Increase in plasminogen activator (t-PA) production, for example, activates a fibrinolytic system and dissolves thrombus. Thereby, the blood vessel itself is revitalized and decrease in abnormal blood pressure and prevention effects for angina pectoris, cerebral thrombosis and intracerebral hemorrhage are achieved.

In addition, (4-2) B cells and plasma cells are proliferated by cytokine inductive production (IL-6: a control factor of humoral immunity). Also the blood vessel massage increases production of IgG, IgM and IgA, participates in differentiation and activation of T cells, affects liver cells and induces acute phase proteins such as CRP and haptoglobin.

The human healing ability enhancing apparatus according to the present invention may be apparatus including an airtight part that is capable of being airtight; a decompression pump that decompresses air pressure in the airtight part and communicates with an exhaust port of the airtight part; and an over-decompression prevention device for preventing over-decompression in which the air pressure in the airtight part is lower than a predetermined threshold air pressure. The airtight part according to the present invention does not assume the case in which the airtight part is aggressively pressurized over the normal pressure (atmospheric pressure). However, it goes without saying that pressurization slightly over the normal pressure possibly occurs as an error range.

For the airtight part of the present invention, the apparatus may include an airtight part that can endure pressure change between the decompression state that is equal to or higher than the threshold air pressure and the wide-range normal pressure state that is the normal pressure or a pressure higher than the decompression state and lower than the normal pressure. Materials constituting the airtight part may be materials that can maintain airtight property and can endure pressure change between the decompression state and the wide-range normal pressure state described above. The airtight part is formed by a single or a combination of materials including metals, resins and woods.

Also, shapes of the airtight part may be shapes that can maintain airtight property and can endure pressure change between the decompression state and the wide-range normal pressure state described above. As described below, since the threshold air pressure itself is 500 hPa or higher, which is not extremely low pressure, the shape is not limited as long as the airtight property is maintained. For example, as long as the airtight property of each other's joint parts is maintained, the airtight part may be constituted as a hexahedral enclosure by assembling rectangular panels.

The decompression pump of the present invention may be a decompression pump that decompresses the air pressure in the airtight part and communicates with the exhaust port of the airtight part and is controlled by the decompression control means. The decompression pump can be used as a single or a combination of decompression pumps including a rotary pump (an oil rotary pump), an oil diffusion pump, a turbomolecular pump, an ion pump, an oil-less pump, and a mechanical booster pump.

The over-decompression prevention device of the present invention may be a device that prevents the air pressure of the airtight part from over-decompression that is lower than a predetermined threshold air pressure. Examples of the device include a device in which a communicating tube communicating outside air with the airtight part includes an open valve that is automatically or forcibly opened when the air pressure in the airtight part is lower than the threshold air pressure.

Preferably, examples of other safety devices other than the over-decompression prevention device further include double, triple or more safety devices such as a device that supplies an amount of outside air lower than an amount of exhausted air in the airtight part by the decompression pump, and an open valve that an examinee entered into the airtight part operates from inside of the airtight part when the examinee senses trouble.

EXAMPLES

Example 1

Constitution of Human Healing Ability Enhancing Apparatus

Figure 4:
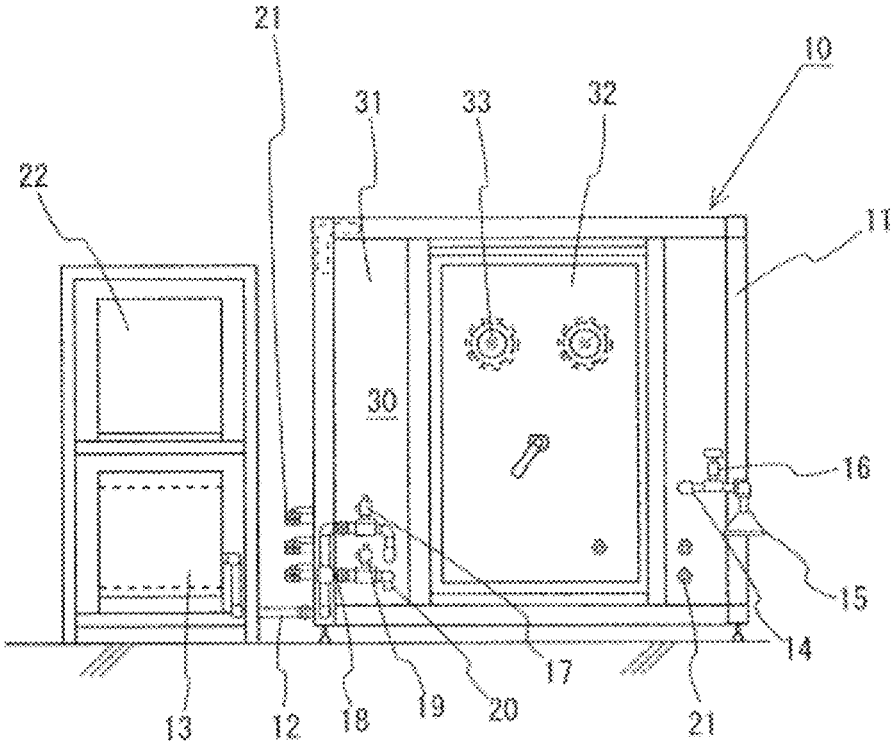
FIG. 4 is a front view illustrating an example of a human healing ability enhancing apparatus of the present invention.
Figure 5:
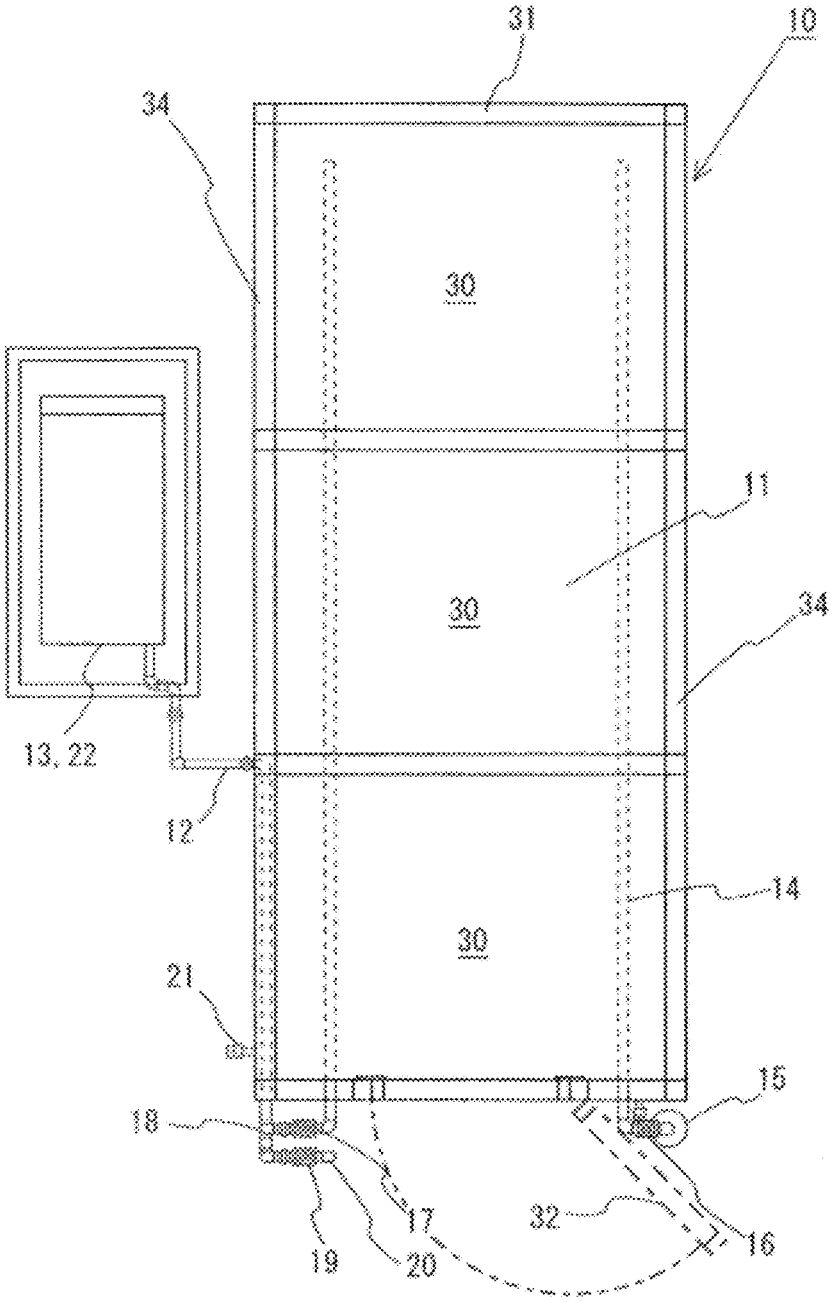
FIG. 5 is a plain view of FIG. 4.
Figure 6:
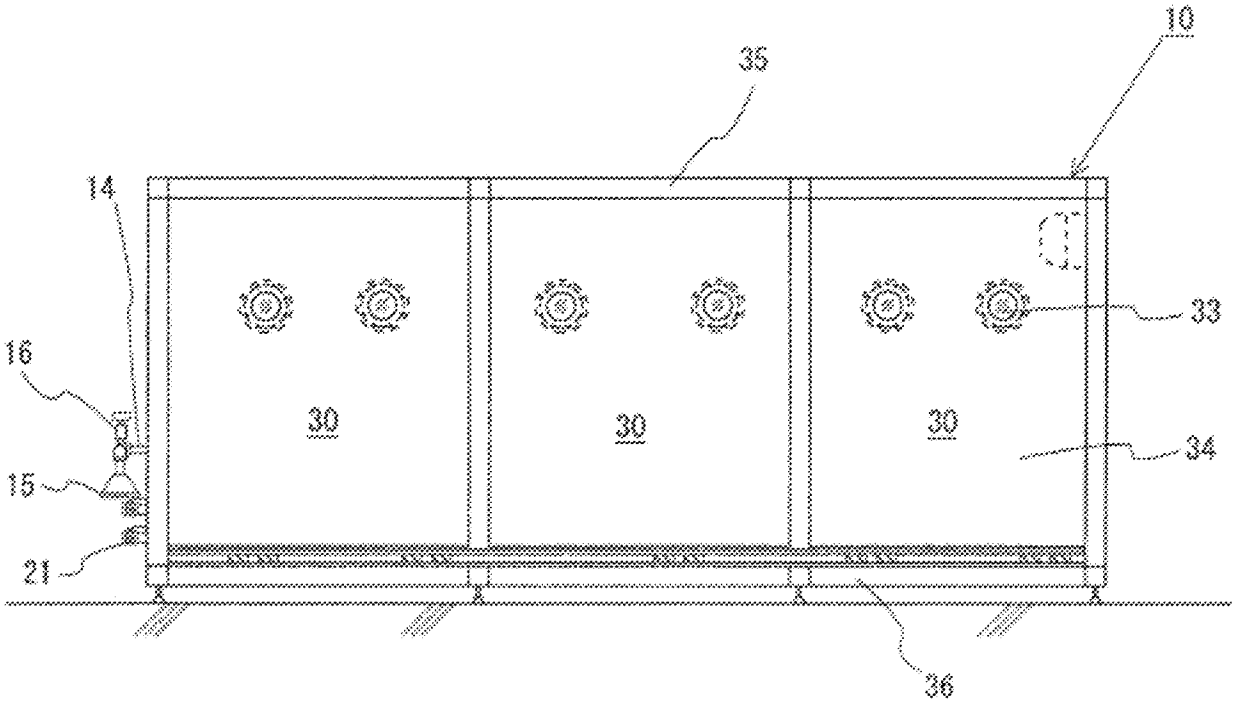
FIG. 6 is a side view of FIG. 4.

FIG. 4 is a front view illustrating one example of a human healing ability enhancing apparatus of the present invention. FIG. 5 is a plain view of FIG. 4. FIG. 6 is a side view of FIG. 4. As illustrated in views, the human healing ability enhancing apparatus 10 in this example includes an airtight part 11 constituted by a plurality of panel boards 30, a decompression pump 13 and communicates with an exhaust pipe 12 whose one end is open to the inside of the airtight part 11, and an air supply pipe 14. At the other end of the air supply pipe 14, whose one end is open to the inside of the airtight part 11 at a location opposite to the exhaust pipe 12, a filter 15 is attached outside of the airtight part 11.

Appearance of the airtight part 11 is an enclosure constituted by a plurality of panel boards 30 that are almost the same size. In this example, the airtight part 11 is constituted by fourteen panel boards. In the front side and the back side (not illustrated), a doorway panel 31 in which an airtight door 32 including two windows 33 at the center part is arranged is used. On both side faces, three side panels 34 including two windows 33, which are coupled each other, are used in each side face. On a ceiling face, three ceiling panels 35, which are coupled each other, are used. On a floor face, three floor panels 36, which are coupled each other, are used in a similar way to the ceiling face.

Although not illustrated, a rim part is arranged so as to surround four sides of the rectangle in each panel board 30. In this constitution, panel boards 30 or adjacent panel boards 30 through a junction member are coupled each other by the rim part. An airtight property between the coupled parts is maintained by coupling using elastic rubber plates inserted between the rim parts of the joined panel boards 30 or between the rim part of the panel board and the junction member.

The air supply pipe 14 is arranged at one side of the front doorway panel 31. In the middle of the air supply pipe 14, a pressure-regulating valve 16 is attached. Outside air through the filter 15 is sequentially and naturally sucked depending on the air pressure in the airtight part 11 by adjusting pressure loss generated by an opening degree of the pressure-regulating valve 16. The opening degree of the pressure-regulating valve 16 is adjusted by a control device 22. The pressure-regulating valve 16 has a structure in which the valve cannot be fully blocked, and thereby the pipe functions as an oxygen deficiency prevention means.

The exhaust pipe 12 is arranged at the other side of the front doorway panel 31. In the middle of the exhaust pipe 12, an electromagnetic valve for exhaust 17 is attached. At a decompression pump 13 side of the exhaust pipe 12, a branch pipe 18 and an over-decompression prevention pipe 20 in communication with outside air through an electromagnetic valve for outside air 19 are arranged. Further, in the airtight part 11, a number of pressure sensors 21 for measuring an internal air pressure of the airtight part 11 are arranged. When the air pressure in the airtight part 11 becomes lower than a predetermined threshold value by some sort of trouble, the decompression pump 13 stops; the electromagnetic valve for outside air 19 opens; outside air is sucked; and thereby, the over-decompression can be prevented.

In the upper part of the decompression pump 13, the control device 22 as the decompression control means for controlling drive of the decompression pump 13 is arranged. Numeric values measured by the pressure sensors 21 in the airtight part 11 are also inputted into the control device 22. Thereby, the control device 22 also controls operation of the electromagnetic valves 17 and 19 and the opening degree of the pressure-regulating valve 16.

FIG. 7 are flow charts illustrating operation of the control device of FIG. 4; FIG. 7*a* is a flow chart illustrating the decompressing process; and FIG. 7*b* is a flow chart illustrating the pressurizing process. As illustrated in FIG. 7*a*, in the decompressing process, the decompression pump 13 is driven by the control device 22. At this time, it is needless to say that this process is performed after the electromagnetic valve for outside air 19 is blocked and the electromagnetic valve for exhaust 17 is opened.

At the time of driving the decompression pump 13, the opening degree of the pressure-regulating valve 16 is set to a minimum opening degree so as to rapidly decompress the pressure. The internal air pressure is periodically checked by the pressure sensors 21 in the airtight part 11 during the drive of the decompression pump 13, and whether the internal air pressure is a predetermined target decompression value or not is determined. When the internal air pressure becomes the predetermined target decompression value, the decompression pump 13 is stopped. At the time of stopping the decompression pump 13, the electromagnetic valve for exhaust 17 is blocked to maintain the internal air pressure of the airtight part 11.

Since the pressure-regulating valve 16 has the structure in which the valve cannot be blocked, the pressure is gradually increased when the drive of the decompression pump 13 is stopped. Therefore, when the target decompression state is intended to be maintained over a long period, if the pressure is increased to a constant level from the target pressure used as a standard, the apparatus may be controlled so as to open the electromagnetic valve for exhaust 17 and to drive the decompression pump 13 again.

As illustrated in FIG. 7*b*, in the pressurizing process, the opening degree of the pressure-regulating valve 16 is increased by the control device 22 to increase the air pressure in the airtight part 11. The internal air pressure is periodically checked by the pressure sensors 21 in the airtight part 11, and whether the internal air pressure is a predetermined target decompression value or not is determined. When the internal air pressure becomes a target pressurizing value (a wide-range normal pressure state), the opening degree of the pressure-regulating valve 16 is decreased to minimum degree.

Similarly, when the pressure-regulating valve 16 has the structure in which the valve cannot be blocked, the pressure gradually rises to the normal pressure, even when the opening degree of the pressure-regulating valve 16 is decreased to the minimum degree. When the wide-range normal pressure state lower than the normal pressure is intended to be maintained over a long period, if the pressure is increased to a constant level from the target pressure used as a standard, the apparatus may be controlled so as to open the electromagnetic valve for exhaust 17 and to drive the decompression pump 13 again.

In the chamber of the airtight part 11 of this example, devices that make an examinee in the chamber comfortable such as an illumination, an air conditioner, a floor heating, a CD player and a TV set can be provided, if necessary. For the air conditioner, the airtight property should be secured by discharging the drain in the chamber of the airtight part in the chamber.

By using the human healing ability enhancing apparatus according to this example, decompressing an air pressure in the airtight part 11 to reduce an air temperature in the airtight part by adiabatic expansion effect, and pressurizing the air pressure from the decompression state to a wide-range normal pressure state that is lower than the normal pressure to restore the air temperature in the airtight part to an air temperature that is equal to or higher than the initial air temperature of the airtight part are sequentially repeated without the air pressure being a constant, and change in the air temperature in the airtight part was measured. The results are shown in Table 1.

As shown in Table 1, it was confirmed that, an air temperature difference of 3° C. or more was capable to be provided for an examinee entering into the airtight part within a time of several minutes, and a stimulus caused by the rapid air temperature change was capable to be provided for the examinee. Further, it was confirmed that the natural healing capacity in which abnormal body tissues and body organs were recovered to healthy body tissues and body organs by the stimulus that was sequentially repeated between the decompressing process being equal to or higher than the threshold air pressure and the pressurizing process being the wide-range normal pressure state that was the normal pressure or a pressure higher than the decompression state and lower than the normal pressure without being a constant air pressure state.

Figure 9:
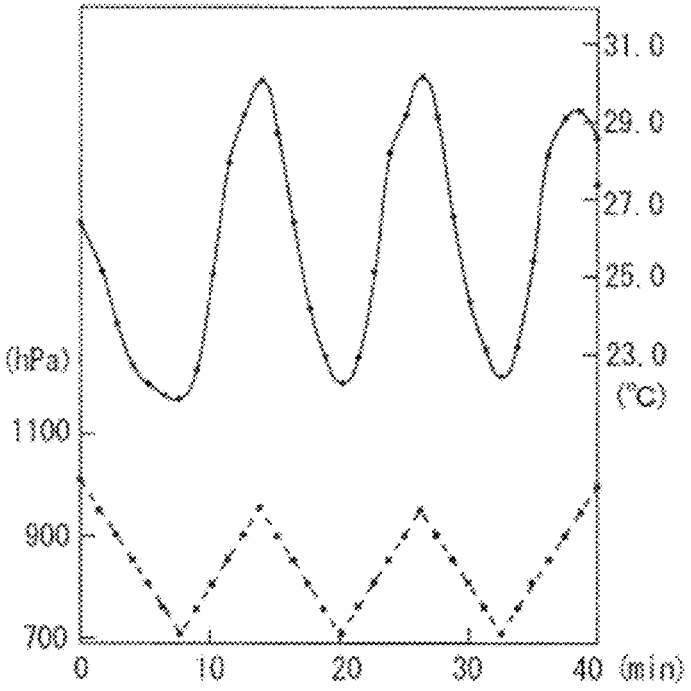
FIG. 9 is a graph illustrating other measurement results of air temperature change in the airtight part when the decompressing process and the pressurizing process, and the vertical axis represents air pressure (hPa) and air temperature (° C.), and the horizontal axis represents time (min)

The results obtained by measuring temperature change in the airtight part when the decompressing process and the pressurizing process are repeated are illustrated in FIG. 8 and FIG. 9. In each graph, the solid line linking black round dots represents the temperature (° C.) in the airtight part, and the dashed line linking black square dots represents the pressure (hPa) in the airtight part.

In FIG. 8, the decompressing process being the normal pressure (1013 hPa) or the air pressure from an air pressure corresponding to an altitude of 200 m (989 hPa) to an air pressure corresponding to an altitude of 1000 m (900 hPa), and the pressurizing process being the air pressure from an air pressure corresponding to an altitude of 1000 m (900 hPa) to an air pressure corresponding to an altitude of 200 m (989 hPa) or the normal pressure (1013 hPa) were repeated at intervals of 2.5 minutes. In FIG. 9, the decompressing process being the normal pressure (1013 hPa) or the air pressure from an air pressure corresponding to an altitude of 200 m (989 hPa) to an air pressure corresponding to an altitude of 3000 m (700 hPa), and the pressurizing process being the air pressure from an air pressure corresponding to an altitude of 3000 m (700 hPa) to an air pressure corresponding to an altitude of 200 m (989 hPa) or the normal pressure (1013 hPa) were repeated at intervals of 6 minute (the initial decompressing and the final pressurizing are performed for 8 minutes).

First, Second, Third

TABLE 1

| air pressure (corresponding to an altitude: m) | elapsed time (min) | temperature (° C.) First | Second | Third |
|---|---|---|---|---|
| 0 | | 19.8 | 19.9 | 19.9 |
| 1000 | 3 | 17.0 | 17.0 | 17.0 |
| 200 | 1.5 | 20.1 | 20.1 | 20.1 |
| 1000 | 2 | 18.5 | 18.4 | 18.4 |
| 200 | 1.5 | 20.7 | 20.8 | 20.9 |

TABLE 1-continued

| air pressure (corresponding to an altitude: m) | elapsed time (min) | temperature (° C.) First | Second | Third |
|---|---|---|---|---|
| 1000 | 2 | 18.7 | 18.6 | 18.6 |
| 200 | 1.5 | 21.4 | 21.5 | 21.5 |
| 2000 | 5 | 16.7 | 16.6 | 16.6 |
| 200 | 3 | 22.7 | 22.7 | 22.7 |
| 3000 | 5 | 16.4 | 16.4 | 16.4 |
| 200 | 3 | 24.7 | 24.7 | 24.7 |

As illustrated in FIG. 8, when an air pressure in the pressurizing process was set to the air pressure of the wide-range normal pressure state being the air pressure corresponding to an altitude of 200 m (989 hPa) or the normal pressure (1013 hPa), it was confirmed that the temperature was higher than the initial outside air temperature (25° C.). In addition, it was found that a temperature range of 23.6° C. to 26.8° C. was repeated for 5 minutes per cycle.

On the other hand, as illustrated in FIG. 9, similar to FIG. 8, when an air pressure in the pressurizing process was set to the air pressure of the wide-range normal pressure state being the air pressure corresponding to an altitude of 200 m (989 hPa) or the normal pressure (1013 hPa), it was confirmed that the temperature was higher than the initial outside air temperature (26° C.). In addition, it was found that a temperature range of 21.5° C. to 30.0° C. was repeated for 12 minutes per cycle.

Example 2

Verification of Human Healing Ability Enhancing Effect (Conditions)

As described above, the natural healing ability enhancing effect by living bodies develops by sequentially repeating the decompressing process set to the decompression state that is equal to or higher than the threshold air pressure and the pressurizing process set to the wide-range normal pressure state that is the normal pressure or a pressure higher than the decompression state and lower than the normal pressure. Hereinafter, the human healing ability enhancing effect was verified.

TABLE 2

| | elapsed time (min) 0 | 15 | 25 | 35 | 50 |
|---|---|---|---|---|---|
| air pressure (hPa) | 1000 | 670 | 945 | 670 | 1000 |

Figure 10:
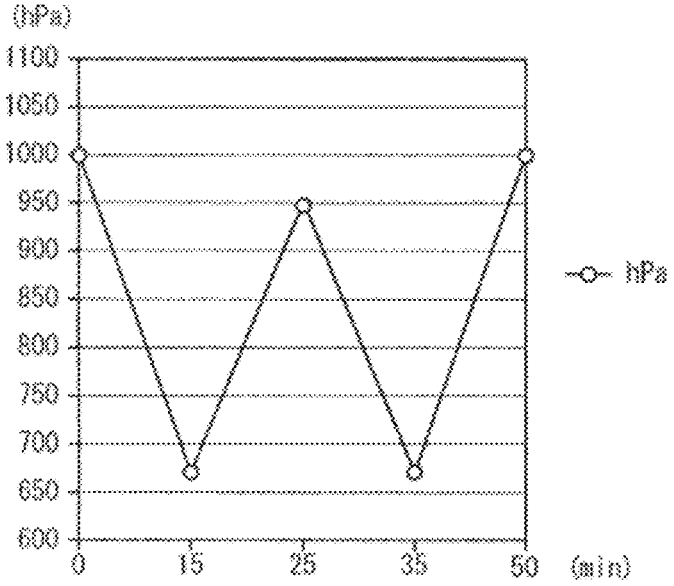
FIG. 10 is a graph illustrating air pressure change in the airtight part in the following examples, and the vertical axis represents air pressure (hPa), and the horizontal axis represents time (min)

At the time of the verification, the decompressing process and the pressurizing process of the human healing ability enhancing apparatus were sequentially and repeatedly operated as shown in Table 2 and illustrated in FIG. 10. The verification data in each example described below were obtained in a manner that the sequential repeat of the decompressing process and the pressurizing process shown in Table 2 and illustrated in FIG. 10 is defined as a one cycle.

Example 3

Verification of Human Healing Ability Enhancing Effect (1)

Figure 11:
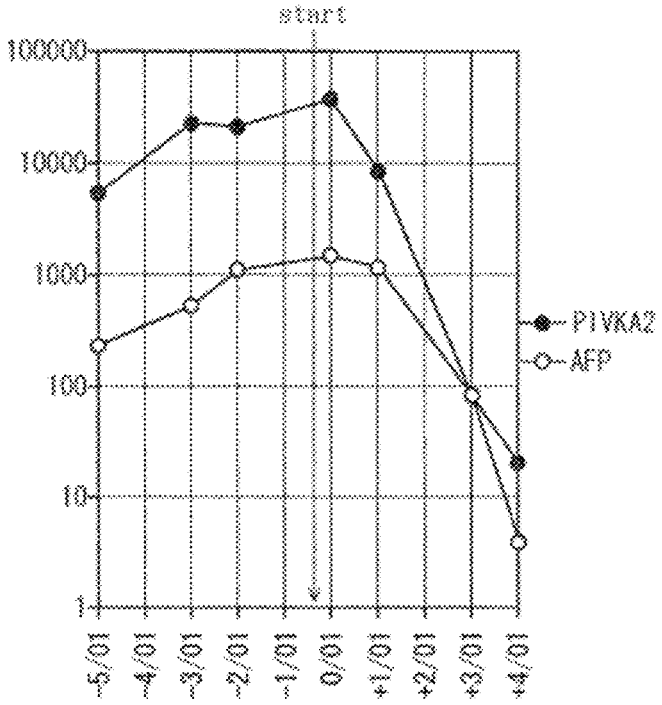
FIG. 11 is a graph illustrating verification results 1 of human healing ability enhancing effect.

The examinee was a man in his sixties with hepatic cell carcinoma. The examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. Transition result of time series information of a tumor marker examination is illustrated in FIG. 11. In FIG. 11, the vertical axis represents values of abnormal prothrombin (PIVKA-2) and alpha-fetoprotein (AFP), and the horizontal axis represents time in unit of month. The first day at the beginning of the month after a start of entering into the apparatus (start) is represent as 0/01 (0 month 1 day), and +1/? (+1 month ? day(s)) and the like are shown in a right direction and −1/? (−1 month ? day(s)) and the like are shown in a left direction using 0/01 as the center.

As illustrated in FIG. 11, it was found that values of the tumor marker of alpha-fetoprotein (AFP) and abnormal prothrombin (PIVKA-2), in which a sign of improvement was not observed before entering the apparatus, were gradually decreased after about one month from the start of entering into the apparatus, and after five months, the value of abnormal prothrombin (PIVKA-2) was decreased to about 20 and a value of alpha-fetoprotein (AFP) was decreased to about 5, as illustrated in FIG. 11.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 4

Verification of Human Healing Ability Enhancing Effect (2)

Figure 12:
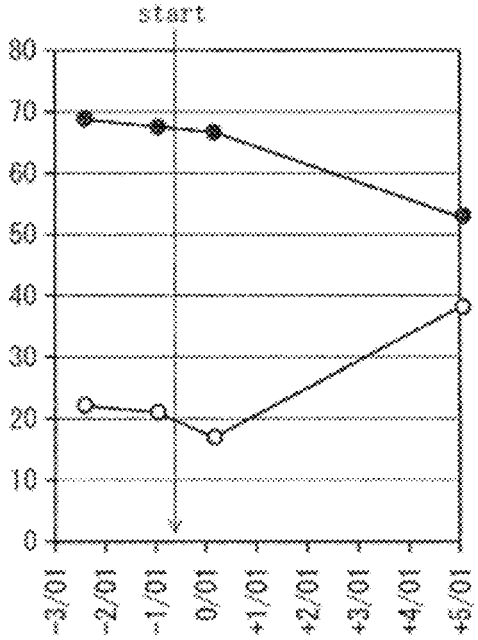
FIG. 12 is a graph illustrating verification results 2 of human healing ability enhancing effect.

The examinee was a woman with breast cancer. The examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. Comparison results of neutrophilic leukocytes and lymphocytes in leukocytes are shown in the following Table 3 and illustrated in FIG. 12. In FIG. 12, the vertical axis represents a ratio (%) of neutrophilic leukocytes (black circles in the graph) and lymphocytes (white circles in the graph), and the horizontal axis represents time in unit of month. The first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0/01 as the center. As illustrated in FIG. 12, it was found that, although a sign of improvement was not observed before entering into the apparatus, the ratio of the neutrophilic leukocytes was gradually decreased and the ratio of the lymphocytes was increased from the start of entering into the apparatus. As the ratio of the lymphocytes was increased, the examinee increased her weight and became cheerful conditions that were capable to be found by appearance.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

TABLE 3

| | −3/20 | −1/04 | 0/10 | +5/05 |
|---|---|---|---|---|
| a ratio (%) of neutrophilic leukocytes | 69.4 | 67.4 | 66.9 | 53.2 |
| a ratio (%) of lymphocytes | 22.4 | 21.1 | 17.2 | 38.4 |

Example 5

Verification of Human Healing Ability Enhancing Effect (3)

Figure 13:
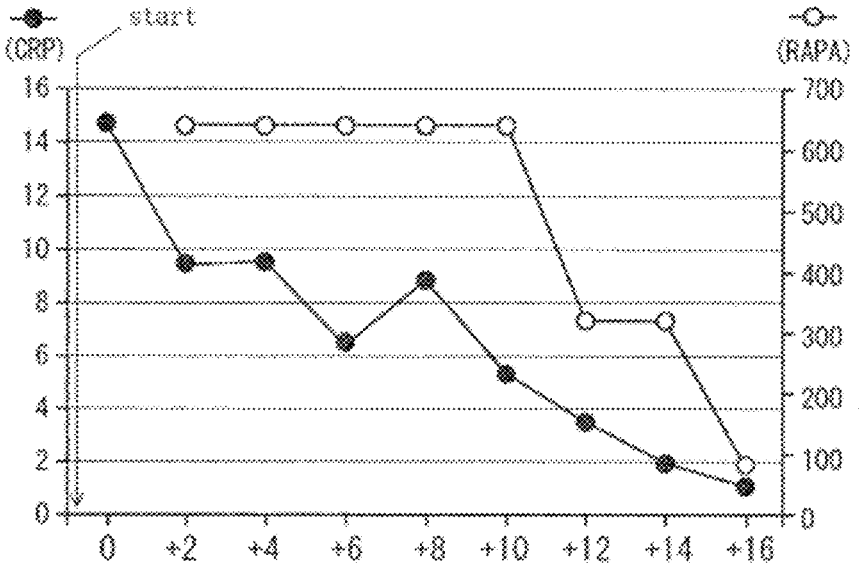
FIG. 13 is a graph illustrating verification results 3 of human healing ability enhancing effect.

The examinee was a woman in her forties with rheumatoid arthritis. The examinee was entered into the human healing ability enhancing apparatus described above, and the entrance into the apparatus was sequentially performed at intervals of about five times of the one cycle per week. Treatments such as medication were in compliance with the direction of the doctor in attendance before the entrance of the apparatus. Results of value transition of C-reactive protein and from a rheumatoid factor (rheumatoid arthritis particle agglitination (RAPA)) are shown in the following Table 4 and illustrated in FIG. 13. In FIG. 13, the vertical axis represents values of C-reactive protein (CRP) and RAPA, and the horizontal axis represents time in unit of month. The first examination day after entering the apparatus was set to 0, and the examination was conducted in every two months.

As illustrated in FIG. 13, the value of the rheumatoid factor (rheumatoid arthritis particle agglitination (RAPA)) (black circles in the graph) was gradually decreased after a start of entering into the apparatus, and the value was recovered close to the normal value after one and a half years from the start of entering into the apparatus. It was found that the C-reactive protein (white circles in the graph), which was an inflammation marker, was started to decrease after about one year from the start of entering into the apparatus, and the examinee was recovered from severe condition to moderate condition after one and a half years from the start of entering into the apparatus.

TABLE 4

| | time in unit of month | | | | | | | | |
|---|---|---|---|---|---|---|---|---|---|
| | 0 | 2 | 4 | 6 | 8 | 10 | 12 | 14 | 16 |
| C-reactive protein: CRP | 14.7 | 9.45 | 9.55 | 6.38 | 8.82 | 5.29 | 3.5 | 1.94 | 1.12 |
| rheumatoid factor: RAPA | | 640 | 640 | 640 | 640 | 640 | 320 | 320 | 80 |

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 6

Verification of Human Healing Ability Enhancing Effect (4)

Figure 14:
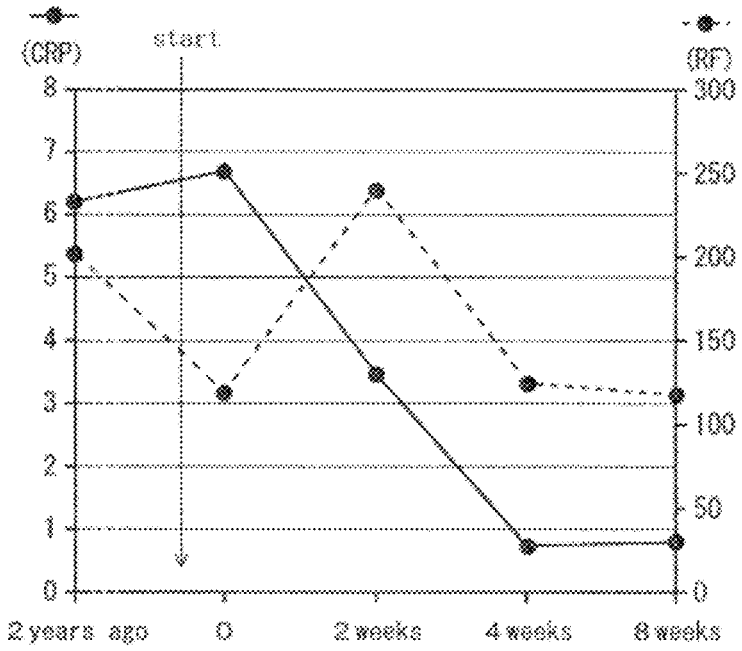
FIG. 14 is a graph illustrating verification results 4 of human healing ability enhancing effect.

The examinee was a woman in her fifties with rheumatism. The examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. Transition results of inflammatory reaction CRP and rheumatoid factors RF values are shown in following Table 5 and illustrated in FIG. 14. In FIG. 14, the vertical axis represents values of the inflammatory reaction CRP (the solid line in the graph) and the rheumatoid factors RF (the dashed line in the graph), and the horizontal axis represents time (week). The first examination day after a start of entering into the apparatus (start) is set to 0, and examination results after 2, 4 and 8 weeks from the examination day are shown.

Two-year-ago examination results are also shown. As illustrated in FIG. 14, a sign of improvement was not observed before entering into the apparatus. Although the value of C-reactive protein (CRP) was not dropped just after entering into the apparatus, the value was surly decreased after that. In addition, although the value of the rheumatoid factor (RF) was temporarily increased, the value was surly decreased after that. The examinee has stopped taking a medicine these days.

TABLE 5

| | Two-year-ago | 0 | After 2 weeks | After 4 weeks | After 8 weeks |
|---|---|---|---|---|---|
| CRP | 6.21 | 6.7 | 3.46 | 0.73 | 0.79 |
| RF | 202 | 118 | 240 | 124 | 117 |

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 7

Verification of Human Healing Ability Enhancing Effect (5)

Figure 15:
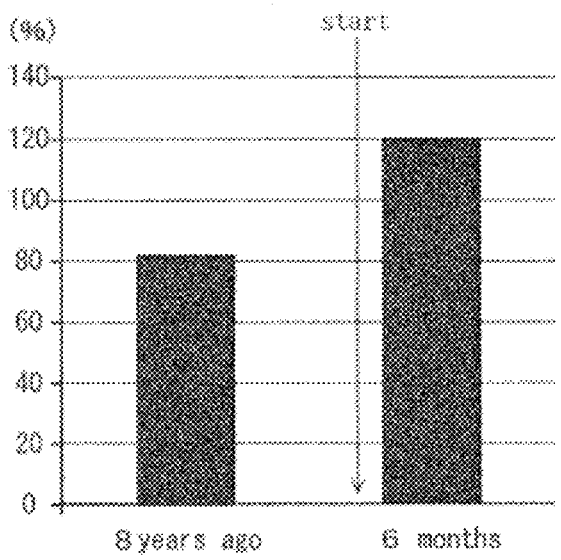
FIG. 15 is a graph illustrating verification results 5 of human healing ability enhancing effect.

The examinee was a woman in her fifties. The examinee was entered into the human healing ability enhancing apparatus described above, and the entrance into the apparatus was sequentially performed at intervals of about five times of the one cycle per week. FIG. 15 is a graph comparing bone densities (YAM: young adult mean). The vertical axis represents percent to YAM, and the horizontal axis represents data of the bone density measured at the time of the right knee surgery for artificial joint replacement 8 years ago and data of the bone density measured after 6 months from the start of entering into the apparatus. As illustrated in FIG. 15, the bone density at 8 years ago was about 82.5. In the case of rheumatism patients, this value may be common in her age. The bone density measured at the time when the left knee was replaced to the artificial joint after 6 months from the start of entering into the apparatus was 120. This value is determined as an about twenty-year old bone density.

According to examinees description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 8

Verification of Human Healing Ability Enhancing Effect (6)

Figure 16:
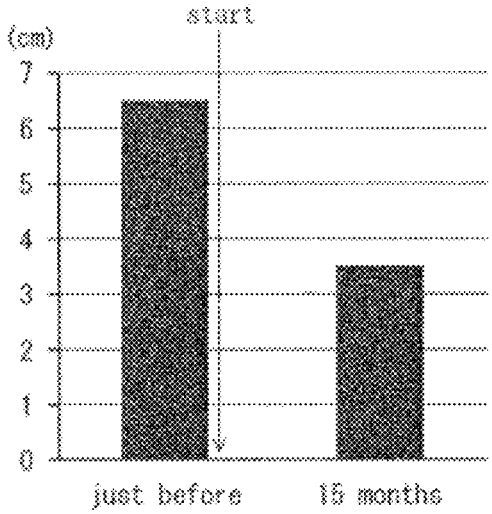
FIG. 16 is a graph illustrating verification results 6 of human healing ability enhancing effect.

The examinee was a woman in her fifties with uterine fibroids. The right ovary of the examinee was surgically removed before due to ovarian cancer, and her uterus and left ovary remained. The examinee had several uterine fibroids. The largest uterine fibroid was 6 cm in diameter, and other several uterine fibroids such as a fibroid having a diameter of 4 cm existed. The examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. The results are illustrated in FIG. 16. In FIG. 16, the size of the largest uterine fibroid was verified. The vertical axis represents a size (cm) of the uterine fibroid and the horizontal axis represents data of just before the start of entering into the apparatus and 15 months later from the start of entering into the apparatus.

In the health check after 15 months from the start of entering into the apparatus, a value of a tumor marker became normal, and the uterine fibroid was shrank from 6 cm in diameter to 3 cm in diameter. Other dotted uterine fibroids were also shrank. Pains in the head, the lower abdomen, the ischial bone, the sacral region, the calves, the insteps and other parts of the body were improved during the repeat of entering into the apparatus, and she also recovered from her fatigue these days.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 8

Verification of Human Healing Ability Enhancing Effect (7)

Figure 17:
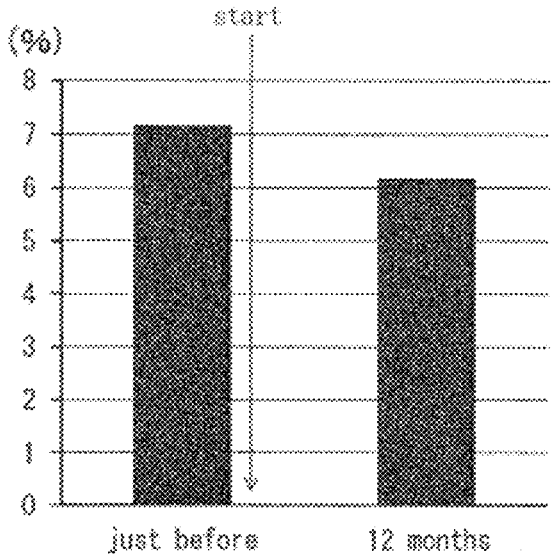
FIG. 17 is a graph illustrating verification results 7 of human healing ability enhancing effect.

The examinee was a woman in her sixties with type II diabetes. FIG. 17 is a graph illustrating transition results of glycohemoglobin (HbA1c). The vertical axis represents a ratio (%) of glycohemoglobin (HbA1c) and the horizontal axis represents data of just before a start of entering into the apparatus and 12 months later from the start of entering into the apparatus. As illustrated in FIG. 17, at just before the start of entering into the apparatus, a value of glycohemoglobin (HbA1c) was 7.2%, and therefore, the examinee was diagnosed as type II diabetes. Thereafter, the examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance into the apparatus.

In the health check after 12 months from the start of entering into the apparatus, it was found that the value of glycohemoglobin (HbA1c) was decreased from 7.2% to 6.2%. Types of medicines for diabetes were decreased from three to one, and administration of the hypocholesterolemic agent was stopped.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 9

Verification of Human Healing Ability Enhancing Effect (8)

Figure 18:
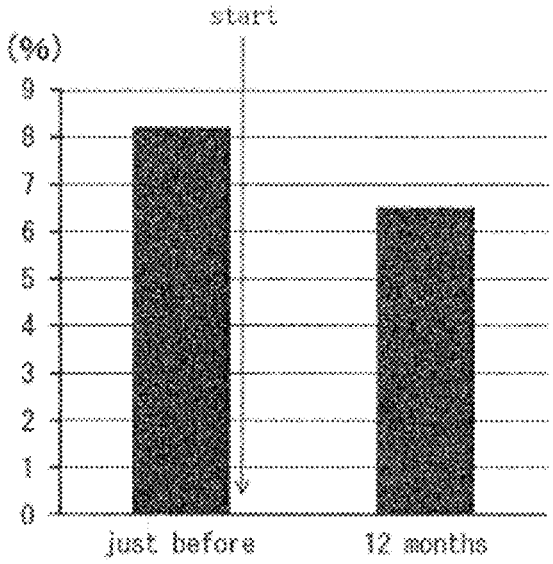
FIG. 18 is a graph illustrating verification results 8 of human healing ability enhancing effect.

The examinee was a man in his sixties with type II diabetes. FIG. 18 is a graph illustrating transition results of glycohemoglobin (HbA1c). The vertical axis represents a ratio (%) of glycohemoglobin (HbA1c) and the horizontal axis represents data of just before a start of entering into the apparatus and 12 months later from the start of entering into the apparatus. The examinee, who possibly developed the diabetes by long term gluttony, was not able to control the diabetes well for about 15 years, and had high values of cholesterol and triglycerides. In the health check before the start of entering into the apparatus, a value of the glycohemoglobin (HbA1c) was 8.2%.

Thereafter, the examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. In the health check after 12 months from the start of entering into the apparatus, it was found that the value of glycohemoglobin (HbA1c) was decreased to 6.5%. It was also found that the values of triglycerides and cholesterol became normal values.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 10

Verification of Human Healing Ability Enhancing Effect (9)

Figure 19:
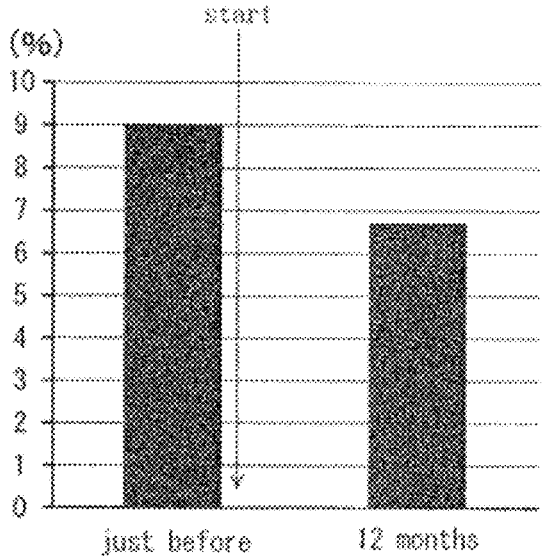
FIG. 19 is a graph illustrating verification results 9 of human healing ability enhancing effect.

The examinee is a woman in her seventies with diabetes and high blood pressure. FIG. 19 is a graph illustrating transition results of glycohemoglobin (HbA1c). The vertical axis represents a ratio (%) of glycohemoglobin (HbA1c) and the horizontal axis represents data of just before starting entering into the apparatus and 12 months later from a start of entering into the apparatus. The diabetes of the examinee was found around 2004, and a blood-sugar level was 330. The examinee had had high triglycerides and cholesterol as well as high blood pressure.

The examinee was entered into the human healing ability enhancing apparatus described above, and the entrance into the apparatus was sequentially performed at intervals of about five times of the one cycle per week. Treatments such as medication were in compliance with the direction of the doctor in attendance from before the entrance of the apparatus. After one year from the start of entering into the apparatus, a blood-sugar level was decreased from 330 to 12-130 and was stable. As illustrated in FIG. 19, while a value of hemoglobin A1c was 9% before the start of entering into the apparatus, the value was decreased to 6.7% after 12 months from the start of entering into the apparatus. Values of cholesterol and triglycerides were also decreased, and these values were problem-free level.

According to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state.

Example 11

Verification of Human Healing Ability Enhancing Effect (10)

As described above, according to examinee's description, it was described that the examinee felt examinee's hands and feet nicely warm because blood stream in examinee's hands and feet were increased by sequentially repeating the decompressing process set to the decompression state that was equal to or higher than the threshold air pressure and the pressurizing process set to the wide-range normal pressure state that was the normal pressure or a pressure higher than the decompression state and lower than the normal pressure without a constant air pressure state. Also, it was confirmed that the natural healing capacity enhancing effect was developed by sequentially repeating the decompressing process and pressurizing process. Therefore, for verifying the effect of the human healing ability enhancing apparatus of the present invention, palm temperature was measured.

Figure 20:
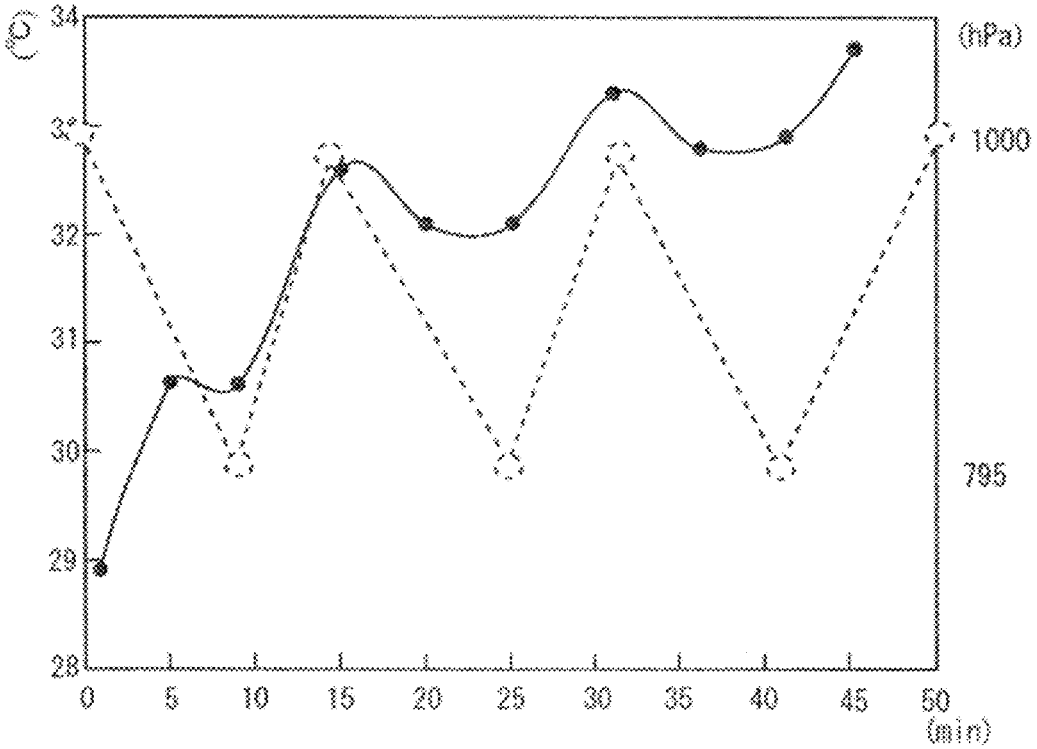
FIG. 20 is a graph illustrating verification results 10 of human healing ability enhancing effect.

Verification data described below were measured in a manner that a one cycle was defined as sequential repeat of the decompressing process and the pressurizing process for 50 minutes, as shown in Table 6 and illustrated in FIG. 20, and the one cycle was sequentially repeated three times. As illustrated in FIG. 20, pressure change per unit time in the pressurizing process is larger than that in the decompressing process. In other words, the pressure was repeatedly controlled so that the pressure was slowly decreased for long periods and was rapidly pressurized. As comparison, an example of sequential control of the decompressing process and the pressurizing process having the same change ratio is shown in Table 7 and illustrated in FIG. 21. The vertical axes of FIG. 20 and FIG. 21 represent palm temperature (° C.) (black circles in the graphs) and air pressure (hPa) (white circles in the graphs), and the horizontal axes represent time (min).

When each decompressing process and pressurizing process was sequentially repeated, the palm temperature was measured with time. The palm temperature was measured using an infrared skin thermometer (commercial name: THERMOFOCUS-PRO).

TABLE 6

| elapsed time (min) | 0 | 1 | 5 | 9 | 9'40 | 15 | 16 | 20 |
|---|---|---|---|---|---|---|---|---|
| air pressure (hPa) | 1000 | | → | | 795 | → | 990 | → |
| palm temperature (° C.) | — | 28.9 | 30.6 | 30.6 | — | 32.6 | — | 32.1 |

| elapsed time (min) | 25 | 26 | 31 | 32 | 36 | 41 | 45 | 50 |
|---|---|---|---|---|---|---|---|---|
| air pressure (hPa) | → | 795 | → | 990 | → | 795 | → | 1000 |
| palm temperature (° C.) | 32.1 | — | 33.3 | — | 32.8 | 32.9 | 33.7 | — |

TABLE 7

| elapsed time (min) | 0 | 1 | 5 | 9 | 13 | 17 | 21 |
|---|---|---|---|---|---|---|---|
| air pressure (hPa) | 1000 | → | | 795 | → | 990 | → |
| palm temperature | — | 29.0 | 30.3 | 30.6 | 30.4 | 30.5 | 30.9 |

TABLE 7-continued

| (° C.) | | | | | | | |
|---|---|---|---|---|---|---|---|
| elapsed time (min) | 25 | 29 | 33 | 37 | 41 | 45 | 50 |
| air pressure (hPa) | 795 | → | 990 | → | 795 | → | 1000 |
| palm temperature (° C.) | 31.2 | 31.0 | 30.9 | 31.1 | 31.8 | 31.8 | |

As shown in Table 6 and Table 7, and as illustrated in FIG. 20 and FIG. 21, it was confirmed that the case that the pressure change per unit time in the pressurizing process was larger than that in the decompressing process, which was shown in Table 6 and illustrated in FIG. 20, provided higher palm temperature rise than the case that the pressure change per unit time in the decompressing process and the pressurizing process was the same. This is probably caused by the following reason. Although the palm temperature tends to decrease during the pressurizing process, the palm temperature is not sufficiently decreased by shortening the period of the pressurizing process compared with the period of the decompressing process, and the subsequent decompressing process starts. Thereby, the palm temperature further increases. In the following each examples, a one cycle was defined as sequential repeat of the decompressing process and the pressurizing process for 50 minutes, as shown in Table 6 and illustrated in FIG. 20, and the one cycle was sequentially repeated three times.

Example 12

Verification of Human Healing Ability Enhancing Effect (11)

The examinee was a fifty-nine-year old woman with ovarian cancer. An extirpative surgery was performed about 2 months before the examinee's entrance into the human healing ability enhancing apparatus described above. At the time of entrance into the human healing ability enhancing apparatus, the examinee, whose cervical lymph node metastasis and hepatic metastasis were proved, was in stage 4. The examinee was entered into the human healing ability enhancing apparatus described above, and the entrance into the apparatus was sequentially performed at intervals of about five times of the one cycle per week. Treatments such as medication were in compliance with the direction of the doctor in attendance. The results are shown in following Table 8 and illustrated in FIG. 22.

In Table 8 and FIG. 22, the first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0/01 as the center. In FIG. 22, FIG. 22*a* illustrates leukocyte count; FIG. 22*b* illustrates lymphocyte count (%); and FIG. 22*c* illustrates the lymphocyte count (counts/ml).

TABLE 8

| | −6/04 | −6/28 | 0/19 | 0/27 | +1/02 |
|---|---|---|---|---|---|
| illustrates leukocyte count | 3800 | 6110 | 3900 | 3500 | 5100 |
| illustrates lymphocyte count (%) | 26.0 | 15.0 | 29.0 | 32.0 | 23.0 |
| illustrates the lymphocyte count (counts/ml) | 988 | 915 | 1131 | 1120 | 1173 |
| tumor marker of the ovarian cancer (CA125) | 9.3 | 7.9 | | | |

As shown in Table 8 and illustrated in FIG. 22, it was found that the lymphocyte count became close to a normal range (1100-1200 counts/ml) after the start of entering into the apparatus and the examinee maintained in a favorable condition.

Example 13

Verification of Human Healing Ability Enhancing Effect (12)

The examinee was a sixty-five-year old man with early gastric cancer (type I), and total gastrectomy was informed to him in other hospital. The examinee was entered into the human healing ability enhancing apparatus described above, and the entrance into the apparatus was sequentially performed at intervals of about five times of the one cycle per week. Treatments such as medication were in compliance with the direction of the doctor in attendance from the start of entering into the apparatus. The results are shown in following Table 9 and illustrated in FIG. 23.

Figure 23A:
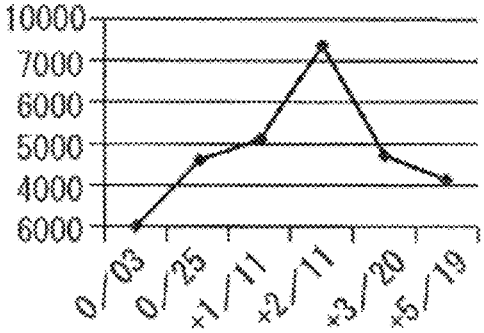
FIG. 23 are graphs illustrating verification results 12 of human healing ability enhancing effect.
Figure 23B:
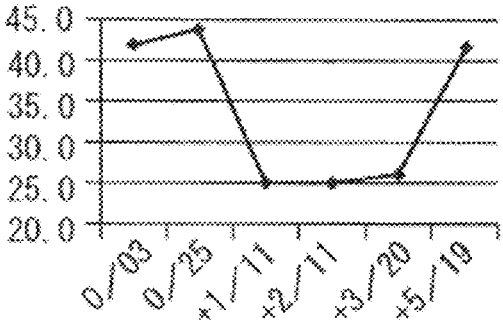
Figure 23C:
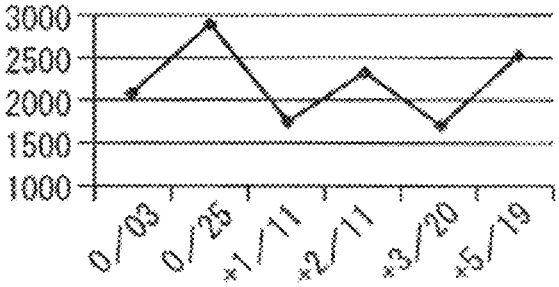

In Table 9 and FIG. 23, the first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0/01 day as the center. In FIG. 22, FIG. 22*a* illustrates leukocyte count; FIG. 22*b* illustrates lymphocyte count (%); and FIG. 22*c* illustrates the lymphocyte count (counts/ml).

TABLE 9

| | 0/03 | 0/25 | +1/11 | +2/11 | +3/20 | +5/19 |
|---|---|---|---|---|---|---|
| illustrates leukocyte count | 5000 | 6600 | 7100 | 9400 | 6700 | 6100 |
| illustrates lymphocyte count (%) | 42.0 | 44.0 | 25.0 | 25.0 | 26.0 | 42.0 |
| illustrates the lymphocyte count (counts/ml) | 2100 | 2904 | 1775 | 2350 | 1742 | 2562 |

As shown in Table 9 and illustrated in FIG. 23, it was found that the lymphocyte count became close to a normal range (1100-1200 counts/ml) for 2 months after the start of entering into the apparatus and the examinee maintained a favorable condition. Therefore, it was found that the examinee avoided the total gastrectomy, and endoscopic submucosal disection was performed on +3/13 in other hospital, and thereby values such as transition lymphocytes were being maintained in favorable conditions.

Example 14

Verification of Human Healing Ability Enhancing Effect (13)

The examinee was a sixty-one-year old woman with left breast cancer (multiple breast cancer 1.6 cm and 0.7 cm) and diabetes, and total mastectomy of her left breast was informed to her in other hospital. The examinee was entered into the human healing ability enhancing apparatus described above, and the entrance into the apparatus was sequentially performed at intervals of about five times of the one cycle per week. Treatments such as medication were in compliance with the direction of the doctor in attendance from the start of entering into the apparatus. The results are shown in following Table 10 and illustrated in FIG. 24.

Figure 24A:
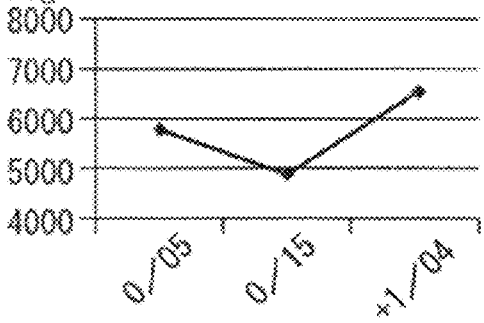
FIG. 24 are graphs illustrating verification results 13 of human healing ability enhancing effect.

In FIG. 24*a*, the vertical axis represents the first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0/01 day as the center. In FIG. 22, FIG. 22*a* illustrates leukocyte count; FIG. 22*b* illustrates lymphocyte count (%); and FIG. 22*c* illustrates the lymphocyte count (counts/ml).

TABLE 10

| | 0/05 | 0/15 | +1/04 |
|---|---|---|---|
| illustrates leukocyte count | 5800 | 4900 | 6600 |
| illustrates lymphocyte count (%) | 25.0 | 34.0 | 31.0 |
| illustrates the lymphocyte count (counts/ml) | 1450 | 1660 | 2046 |
| blood-sugar | 120 | | 106 |
| ratio (%) of glycohemoglobin (HbA1c) | 6.4 | | 6.1 |

Figure 24B:
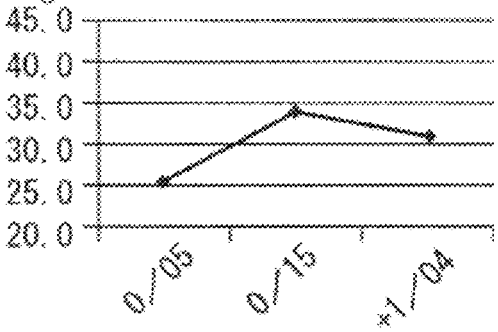
Figure 24C:
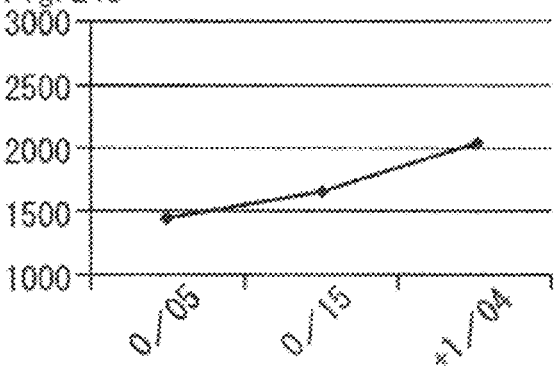

As shown in Table 10 and illustrated in FIG. 24, the lymphocyte count increased after one month from the start of entering into the apparatus. It was confirmed that no metastasis in regions other than the left breast existed and also no invasion into fascia of pectoralis major muscle existed by examination using PET, CT and the like. Consequently, thermocoagulation therapy was performed in +1/07 in other hospital and the recovery process has been observed. It was found that her blood-sugar level and the value of HbA1c were within the range of the normal value during one month, possibly because of mildness of diabetes.

Example 15

Verification of Human Healing Ability Enhancing Effect (14)

The examinee was a fifty-nine-year old woman with ovarian cancer and diabetes and total mastectomy of her ovarian cancer was performed in other hospital (−1/08). From one month after the surgery, the examinee was entered into the human healing ability enhancing apparatus, and the entrance into the apparatus was sequentially performed at intervals of about five times of the one cycle per week. Treatments such as medication were in compliance with the direction of the doctor in attendance from the start of entering into the apparatus. The results are shown in following Table 11 and illustrated in FIG. 25.

TABLE 11

| | 0/11 | +1/02 | +2/02 |
|---|---|---|---|
| illustrates leukocyte count | 7100 | 5800 | 7300 |
| illustrates lymphocyte count (%) | 22.0 | 32.0 | 40.0 |
| illustrates the lymphocyte count (counts/ml) | 1562 | 1856 | 2920 |
| tumor marker of the ovarian cancer (CA125) | 189.3 | | 28.5 |
| tumor marker of digestive cancer CA19-9 | 8.7 | | 10.8 |
| tumor marker of digestive cancer CEA | 2.0 | | 2.7 |

Figure 25A:
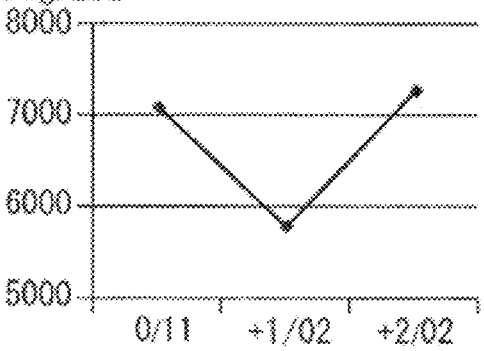
FIG. 25 are graphs illustrating verification results 14 of human healing ability enhancing effect.
Figure 25B:
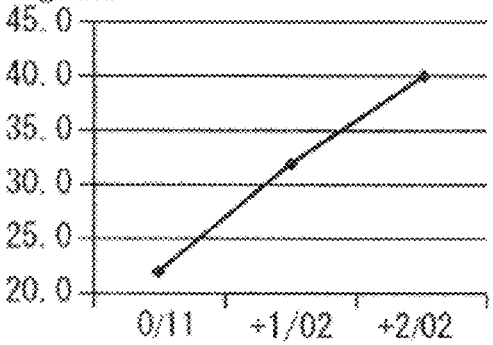
Figure 25C:
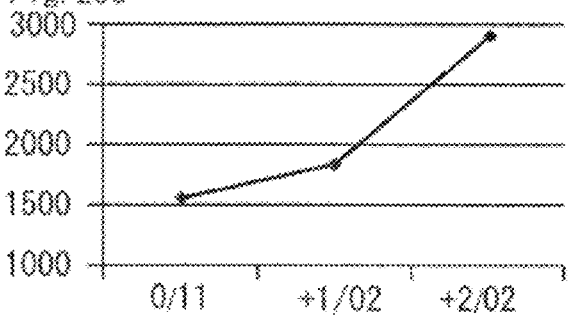

In Table 11 and FIG. 25, the first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0/01 as the center. In FIG. 22, FIG. 22*a* illustrates leukocyte count; FIG. 22*b* illustrates lymphocyte count (%); and FIG. 22*c* illustrates the lymphocyte count (counts/ml).

As shown in Table 11 and FIG. 25, the lymphocyte count was increased and a tumor marker of the ovarian cancer (CA125) was drastically decreased to a normal value after two months from the start of entering into the apparatus. A tumor marker of digestive cancer CA19-9 and CEA were normal values from just after the start of entering into the apparatus.

Example 16

Verification of Human Healing Ability Enhancing Effect (15)

The examinee was a sixty-one-year old woman, and surgery of her sigmoid colon cancer was performed in other hospital 3 years and 4 months ago before a start of entering into the human healing ability enhancing apparatus. Thereafter, brain metastasis was confirmed 10 months ago before the start of entering into the apparatus. Therefore, radiotherapy (hospital visit for three days) was performed. However, pulmonary metastasis was confirmed 7 months ago before the start of entering into the apparatus. Therefore, dendritic cell therapy was performed 4 months ago before the start of entering into the apparatus (8 times in total). Palliative care was recommended just before the start of entering into the apparatus. The examinee started to enter into the human healing ability enhancing apparatus, and the entrance into the apparatus was sequentially performed at intervals of about five times of the one cycle per week. Treatments such as medication were in compliance with the direction of the doctor in attendance from the start of entering into the apparatus. The results are shown in following Table 12 and illustrated in FIG. 26.

Figure 26A:
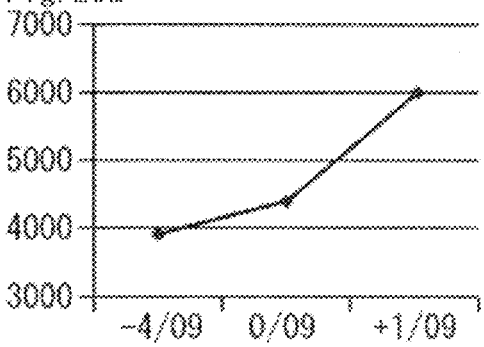
FIG. 26 are graphs illustrating verification results 15 of human healing ability enhancing effect.
Figure 26B:
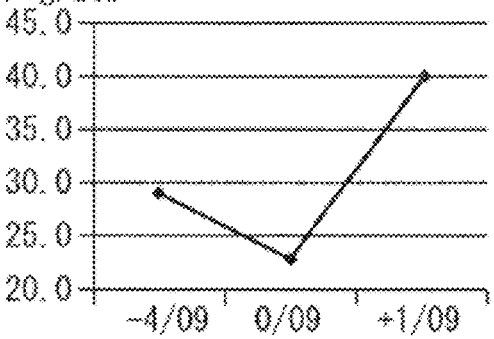
Figure 26C:
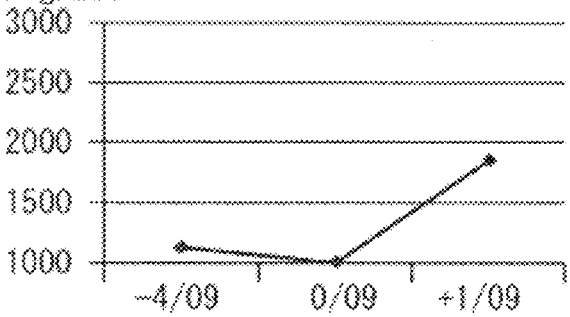

In Table 12 and FIG. 26, the first day at the beginning of the month after entering into apparatus is represented as 0/01 (0 month 1 day), and +1/? (+1 month ? day(s)) and the like are shown in a right direction and −1/? (−1 month ? day(s)) and the like are shown in a left direction using 0 month/1 day as the center. In FIG. 22, FIG. 22*a* illustrates leukocyte count; FIG. 22*b* illustrates lymphocyte count (%); and FIG. 22*c* illustrates the lymphocyte count (counts/ml).

TABLE 12

| | −4/11 | 0/09 | +1/06 |
|---|---|---|---|
| illustrates leukocyte count | 3900 | 4400 | 6000 |
| illustrates lymphocyte count (%) | 29.0 | 23.0 | 40.0 |
| illustrates the lymphocyte count (counts/ml) | 1131 | 1012 | 1860 |
| tumor marker of digestive cancer CYFRA | | 0.4 | 0.4 |
| tumor marker of digestive cancer CEA | | 1.1 | 0.8 |

As shown in Table 12 and illustrated in FIG. 26, both of the lymphocyte count and the lymphocyte count were increased after one month from the start of entering into the apparatus. A recovery process of the examinee has still been observed.

Example 17

Verification of Human Healing Ability Enhancing Effect (16)

The examinee was a forty-one-year old man with diabetes. The examinee started to enter into the human healing ability enhancing apparatus described above, and the entrance into the apparatus was sequentially performed at intervals of about five times of the one cycle per week. Treatments such as medication were in compliance with the direction of the doctor in attendance from the start of entering into the apparatus. The results are shown in following Table 13 and illustrated in FIG. 27.

TABLE 13

| | blood-sugar level (mg/dl) | illustrates a transition result of HbA1c (%) | C-peptide immuno-reactivity | Ketone bodies | Uric acid |
|---|---|---|---|---|---|
| At first visit | 366 | 10.9 | 1.73 | – | 3+ |
| After 1 week | 256 | 10.6 | (Not measure) | – | 3+ |
| After 5 weeks | 152 | 10.1 | 0.93 | – | – |
| After 8 weeks | 113 | 8.6 | 0.83 | 1+ | – |
| After 13 weeks | 117 | 8.3 | 0.94 | – | – |
| After 17 weeks | 90 | 7.4 | 0.68 | ± | – |
| After 23 weeks | 109 | 6.7 | 0.84 | – | – |
| After 27 weeks | 117 | 6.2 | 0.96 | – | – |
| After 30 weeks | 117 | 6.2 | (Not measure) | – | – |
| After 32 weeks | 128 | 6.5 | 1.09 | – | – |

Figure 27A:
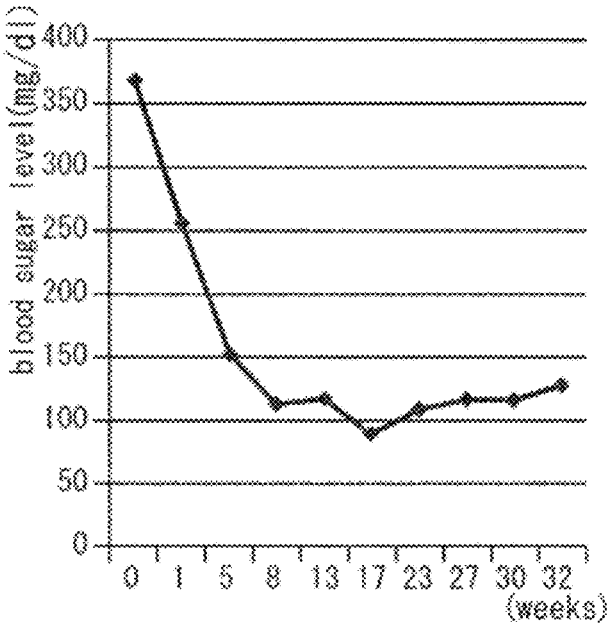
FIG. 27 are graphs illustrating verification results 16 of human healing ability enhancing effect.
Figure 27B:
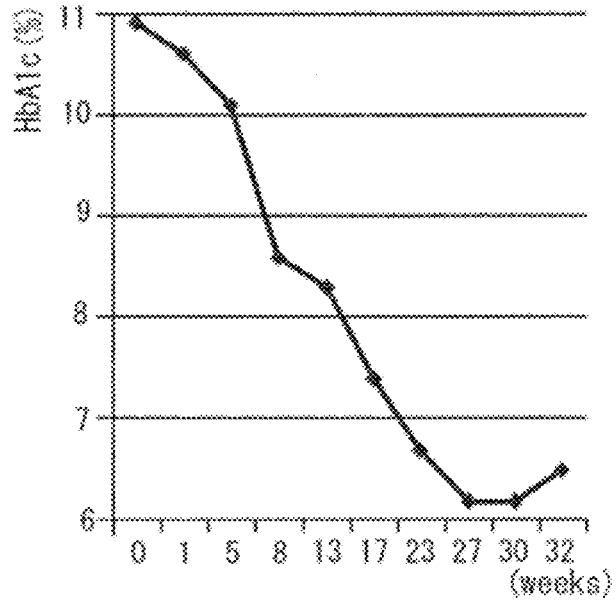

FIG. 27*a* illustrates a transition result of a blood-sugar level (mg/dl) and FIG. 27*b* illustrates a transition result of HbA1c (%). The vertical axes of FIG. 27*a* and FIG. 27*b* represent a blood-sugar level (mg/dl) or HbA1c (%), and the horizontal axes represent time (week).

As shown in Table 13 and FIG. 27, the case of the diabetes was improved with time and the diabetes was almost completely cured in about a half year.

Example 18

Verification of Human Healing Ability Enhancing Effect (17)

The examinee was a forty-three-year old man with diabetes. The examinee started to enter into the human healing ability enhancing apparatus described above, and the entrance into the apparatus was sequentially performed at intervals of about five times of the one cycle per week. Treatments such as medication were in compliance with the direction of the doctor in attendance from the entrance into the apparatus. The results are shown in following Table 14 and FIG. 28.

Figure 28A:
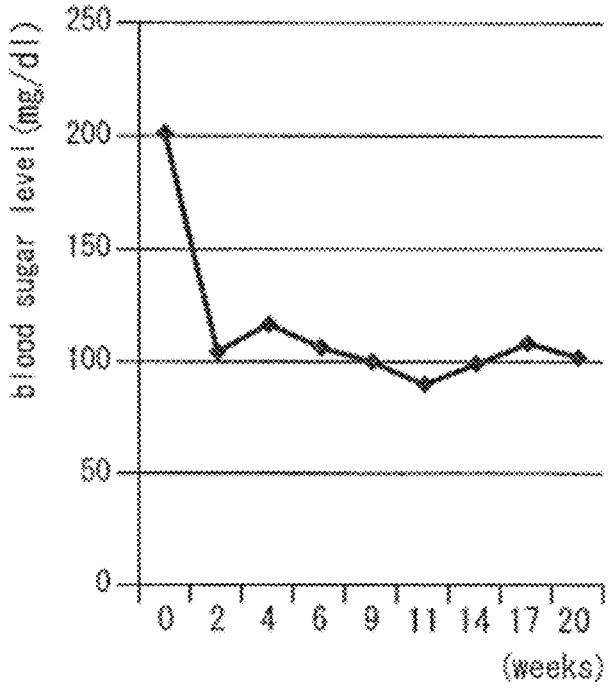
FIG. 28 are graphs illustrating verification results 17 of human healing ability enhancing effect.
Figure 28B:
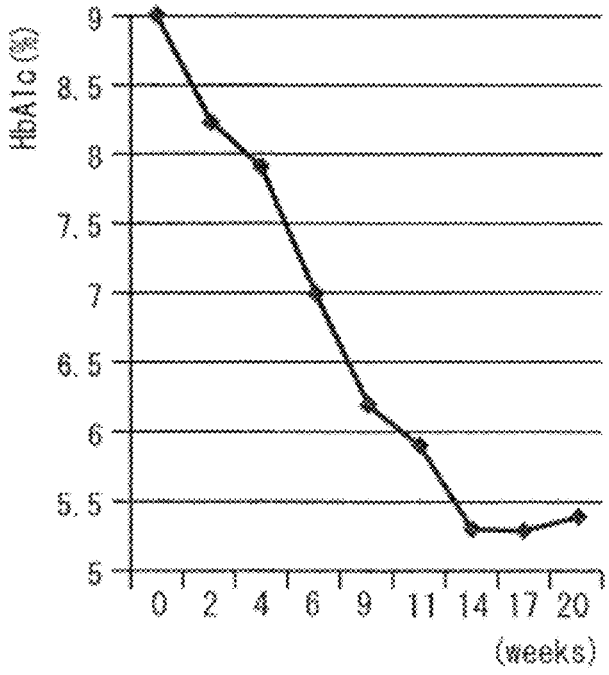

FIG. 28*a* illustrates a transition result of a blood-sugar level (mg/dl) and FIG. 28*b* illustrates a transition result of HbA1c (%). The vertical axes of FIG. 27*a* and FIG. 27*b* represent a blood-sugar level (mg/dl) or HbA1c (%), and the horizontal axes represent time (week).

TABLE 14

| | blood-sugar level (mg/dl) | illustrates a transition result of HbA1c (%) | C-peptide immuno-reactivity | Ketone bodies | Uric acid |
|---|---|---|---|---|---|
| At first visit | 201 | 9.0 | 2.77 | – | 4+ |
| After 2 weeks | 104 | 8.2 | (Not measure) | (Not measure) | 1+ |
| After 4 weeks | 117 | 7.9 | 0.79 | – | – |
| After 6 weeks | 106 | 7.0 | 1.19 | – | – |
| After 9 weeks | 100 | 6.2 | 1.26 | – | – |
| After 11 weeks | 90 | 5.9 | (Not measure) | – | – |
| After 14 weeks | 99 | 5.3 | 1.02 | – | – |
| After 17 weeks | 109 | 5.3 | (Not measure) | – | – |
| After 20 weeks | 102 | 5.4 | 1.04 | – | – |

As shown in Table 14 and illustrated in FIG. 28, the case of the diabetes was improved with time and the diabetes was almost completely cured during about three months.

INDUSTRIAL APPLICABILITY

According to the present invention, the human healing ability enhancing apparatus that can more favorably provide the stimulus for enhancing natural healing capacity of the living body and a method for actuating thereof are obtained, and human healing ability effect in which abnormal body tissues and body organs are recovered to healthy body tissues and body organs becomes more effective.

DESCRIPTION OF THE REFERENCE NUMERALS

10: Human Healing Ability Enhancing Apparatus
11: Airtight Part
12: Exhaust Pipe
13: Decompression Pump
14: Air Supply Pipe
15: Filter
16: Pressure-regulating Valve
17: Electromagnetic Valve for Exhaust
18: Branch Pipe
19: Electromagnetic Valve for Outside Air
20: Over-decompression Prevention Pipe
21: Pressure Sensors
22: Control Device
30: Panel Board
31: Doorway Panel
32: Airtight Door
33: Window
34: Side Panel
35: Ceiling Panel
36: Floor Panel

The invention claimed is:

1. A method for actuating a human healing ability enhancing apparatus comprising:

an airtight part that is capable of being airtight;

a decompression pump that decompresses an air pressure in the airtight part and communicates with an exhaust port of the airtight part; and an over-decompression prevention device for preventing over-decompression in which the air pressure in the airtight part is lower than a predetermined threshold air pressure; the method comprising:

decompressing an air pressure in the airtight part by a decompressing process to a decompression state that is equal to or higher than the threshold air pressure during 1 to 60 minute(s) to reduce an air temperature in the airtight part by adiabatic expansion effect; and pressurizing the air pressure in the decompression state by a pressurizing process to a normal pressure or a wide-range normal pressure state that is a pressure higher than the decompression state and lower than the normal pressure during 1 to 60 minute(s) to restore the air temperature in the airtight part to an air temperature that is equal to or higher than the initial air temperature of the airtight part;

wherein the decompressing process and the pressurizing process are sequentially repeated; and the pressurizing process has higher pressure change per unit time than the decompressing process when the decompressing process and the pressurizing process are sequentially repeated.

2. The method for actuating the human healing ability enhancing apparatus according to claim 1, wherein the airtight part encapsulates a whole human body in the airtight part.

3. The method for actuating the human healing ability enhancing apparatus according to claim 1, wherein the human healing ability enhancing apparatus further comprises an air supply pipe that sequentially sucks outside air naturally depending on the air pressure in the airtight part.

4. The method for actuating the human healing ability enhancing apparatus according to claim 1, wherein the air pressure in the airtight part ranges from an air pressure corresponding to an altitude of 200 m to an air pressure corresponding to an altitude of 3000 m.

5. A human healing ability enhancing apparatus comprising:

an airtight part that is capable of being airtight;

a decompression pump that decompresses an air pressure in the airtight part and communicates with an exhaust port of the airtight part;

an over-decompression prevention device for preventing over-decompression in which the air pressure in the airtight part is lower than a predetermined threshold air pressure; and a decompression control unit, wherein the decompression control unit sequentially and repeatedly controls a decompressing process in which the air pressure in the airtight part is changed to a decompression state that is equal to or higher than the threshold air pressure during 1 to 60 minutes) and a pressurizing process in which the decompression state is changed to a wide-range normal pressure state that is a normal pressure or a pressure higher than the decompression state and lower than the normal pressure during 1 to 60 minute(s), and the decompression control unit provides higher pressure change per unit time in the pressurizing process than that in the decompressing process.

6. The human healing ability enhancing apparatus according to claim 5, wherein the airtight part encapsulates a whole human body in the airtight part.

7. The human healing ability enhancing apparatus according to claim 6, further comprising an oxygen deficiency prevention unit for preventing oxygen deficiency in the airtight part.

8. The human healing ability enhancing apparatus according to claim 5, wherein the air pressure in the airtight part ranges from an air pressure corresponding to an altitude of 200 m to an air pressure corresponding to an altitude of 3000 m.

* * * * *